US012416424B2

(12) United States Patent
Meles et al.

(10) Patent No.: US 12,416,424 B2
(45) Date of Patent: Sep. 16, 2025

(54) APPARATUS AND METHODS FOR USER INTERFACE FOR EFFICIENT ANALYSIS AND SELECTION OF DESICCANT HVAC SYSTEMS

(71) Applicant: Mojave Energy Systems, Inc., Sunnyvale, CA (US)

(72) Inventors: Aaron Meles, Grand Rapids, MI (US); Philip Farese, Winchester, MA (US); Rachel Ellman, Cupertino, CA (US)

(73) Assignee: Mojave Energy Systems, Inc., Sunnyvale, CA (US)

( * ) Notice: Subject to any disclaimer, the term of this patent is extended or adjusted under 35 U.S.C. 154(b) by 0 days.

(21) Appl. No.: 19/029,041

(22) Filed: Jan. 17, 2025

(65) Prior Publication Data

US 2025/0237398 A1 Jul. 24, 2025

Related U.S. Application Data

(60) Provisional application No. 63/622,887, filed on Jan. 19, 2024.

(51) Int. Cl.
*F24F 11/46* (2018.01)
*F24F 11/52* (2018.01)
(Continued)

(52) U.S. Cl.
CPC ..... *F24F 11/46* (2018.01); *F24F 11/52* (2018.01); *F24F 2110/10* (2018.01); *F24F 2110/20* (2018.01); *F24F 2110/50* (2018.01); *F24F 2120/12* (2018.01); *F24F 2120/14* (2018.01)

(58) Field of Classification Search
CPC ..... F24F 11/46; F24F 11/52; F24F 2110/10; F24F 2110/20; F24F 2110/50;
(Continued)

(56) References Cited

U.S. PATENT DOCUMENTS 5,058,388 A * 10/1991 Shaw ..... F24F 11/77 62/93
11,480,364 B2 * 10/2022 Ewert ..... F24H 15/20
(Continued)

FOREIGN PATENT DOCUMENTS

WO WO-2024129618 A1 6/2024
WO WO-2024211820 A2 10/2024

OTHER PUBLICATIONS

International Search Report and Written Opinion for Application No. PCT/US2025/012022, dated Mar. 28, 2025, 15 pages.

*Primary Examiner* — Alicia M. Choi
(74) *Attorney, Agent, or Firm* — COOLEY LLP

(57) ABSTRACT

In some embodiments, a method for analysis of a desiccant air processing unit includes receiving an air characteristic and generating, based on the air characteristic, a psychrometric chart with a representation of the air characteristic. The method includes determining, based on the air characteristic and a plurality of air processing units, a subset of air processing units and generating, based on the subset of air processing units and the air characteristic, output data associated with possible outputs from the subset of air processing units. The method includes defining a set of regions on the psychrometric chart based on the output data associated with each air processing unit from the subset of air processing units, each region from the set of regions being associated with a different air processing unit from the subset of air processing units and sending, to a user device, the psychrometric chart for output.

26 Claims, 12 Drawing Sheets

(51) Int. Cl.

| | |
|---|---|
| *F24F 110/10* | (2018.01) |
| *F24F 110/20* | (2018.01) |
| *F24F 110/50* | (2018.01) |
| *F24F 120/12* | (2018.01) |
| *F24F 120/14* | (2018.01) |

(58) Field of Classification Search
CPC ..... F24F 2120/12; F24F 2120/14; F24F 11/0008; F24F 11/30; F24F 3/1423; F24F 11/64; Y02B 30/70
See application file for complete search history.

(56) References Cited

U.S. PATENT DOCUMENTS

| | | | | |
|---|---|---|---|---|
| 11,739,967 | B1 * | 8/2023 | Craft | F24F 11/74 62/127 |
| 12,078,378 | B1 * | 9/2024 | Williams | F24F 11/30 |
| 2006/0234621 | A1 | 10/2006 | Desrochers et al. | |
| 2011/0162394 | A1 * | 7/2011 | Lee | F24F 11/46 62/93 |
| 2012/0023976 | A1 * | 2/2012 | Kim | F24F 11/30 62/89 |
| 2012/0030347 | A1 * | 2/2012 | Hsu | G06F 11/3086 709/224 |
| 2013/0131872 | A1 * | 5/2013 | Kuroiwa | F24F 11/62 700/276 |
| 2017/0161164 | A1 * | 6/2017 | Hsu | G06F 11/3058 |
| 2020/0149767 | A1 * | 5/2020 | Salem | F24F 11/46 |
| 2020/0300489 | A1 * | 9/2020 | Morishita | G05B 15/02 |
| 2022/0221180 | A1 * | 7/2022 | Ashizawa | H04L 12/2803 |
| 2022/0397296 | A1 * | 12/2022 | Pickle | F24F 7/00 |
| 2023/0280049 | A1 | 9/2023 | Farese et al. | |
| 2023/0332780 | A1 | 10/2023 | Meles et al. | |
| 2024/0263823 | A1 * | 8/2024 | Tsujimura | F24F 11/52 |
| 2025/0000528 | A1 | 1/2025 | Savastano et al. | |

* cited by examiner

APPARATUS AND METHODS FOR USER INTERFACE FOR EFFICIENT ANALYSIS AND SELECTION OF DESICCANT HVAC SYSTEMS

CROSS-REFERENCE TO RELATED APPLICATIONS

This application claims priority to and benefit of U.S. Provisional Patent Application No. 63/622,887, titled "APPARATUS AND METHODS FOR USER INTERFACE FOR EFFICIENT ANALYSIS AND SELECTION OF DESICCANT HVAC SYSTEMS," filed Jan. 19, 2024, the disclosure of which is incorporated herein by reference.

BACKGROUND

Heating, ventilation, and air conditioning (HVAC) systems provide cooling and/or dehumidification of a building space during the summer, and heating and/or humidification of such a space during winter. Some known HVAC systems operate on any combination of fresh air and recirculated air. Buildings, particularly commercial buildings, can use a certain amount of ventilation of fresh, outside air, to prevent occupants being exposed to poor air quality caused by excess $CO_2$, volatile organics, and other contaminants present in building as emitted by building materials, furnishings, and activities of occupants, processes, or equipment in buildings. Additionally, heating, cooling, humidification, and/or dehumidification of air can be desired to offset the heat and moisture loads inside a building.

Determining the loads on an HVAC system and selecting equipment to meet the determined loads can require engineering expertise and calculations which can introduce additional upfront costs when installing an HVAC system. Further, improper and/or inadequate engineering design can cause long term problems to building operations as equipment that is poorly selected can result in inadequate ventilation and uncomfortable conditions in the building. Certain systems for assisting in selecting equipment exist, but can be time consuming and difficult to use, offer insufficient flexibility in selecting equipment, and provide limited visualization or other analytic support to the user. Thus, there is a need for a system for selecting HVAC equipment that accommodates the design flexibility and engineering analysis needed for modern building design.

SUMMARY

In some embodiments, a method for analysis of a desiccant air processing unit includes receiving, from a user device, an air characteristic. The method includes generating, based on the air characteristic, a psychrometric chart with a representation of the air characteristic. The method includes determining, based on the air characteristic and a plurality of air processing units, a subset of air processing units. The method includes generating, based on the subset of air processing units and the air characteristic, output data associated with possible outputs from air processing units from the subset of air processing units. The method includes defining a set of regions on the psychrometric chart based on the output data associated with each air processing unit from the subset of air processing units, each region from the set of regions being associated with a different air processing unit from the subset of air processing units. The method includes sending, to the user device, the psychrometric chart for output.

In some embodiments, an apparatus includes one or more memories and one or more processors operatively coupled to the one or more memories. The one or more processors are configured to receive, from a user device, a target air characteristic. The one or more processors are configured to determine, based on the target air characteristic, a subset of air processing units. The one or more processors are configured to determine, for each air processing unit from the subset of air processing units, an energy usage based on the target air characteristic. The one or more processors are configured to select a candidate air processing unit based on the energy usage associated with each air processing unit from the subset of air processing units. The one or more processors are configured to send, to the user device, the candidate air processing unit.

In some embodiments, a method for analysis of a desiccant air processing unit includes generating, based on a predetermined air characteristic, a psychrometric chart with a representation of the predetermined air characteristic, the psychrometric chart including a representation of a supply characteristic. The method includes receiving, from a user device, an input associated with the representation of a supply characteristic. The method includes determining, based on the input and a plurality of air processing units, a subset of air processing units. The method includes generating, based on the subset of air processing units, output data associated with possible outputs from air processing units from the subset of air processing units. The method includes defining a set of regions on the psychrometric chart based on the output data associated with each air processing unit from the subset of air processing units, each region from the set of regions being associated with a different air processing unit from the subset of air processing units. The method includes sending, to the user device, the psychrometric chart for output.

DETAILED DESCRIPTION

Figure 1:
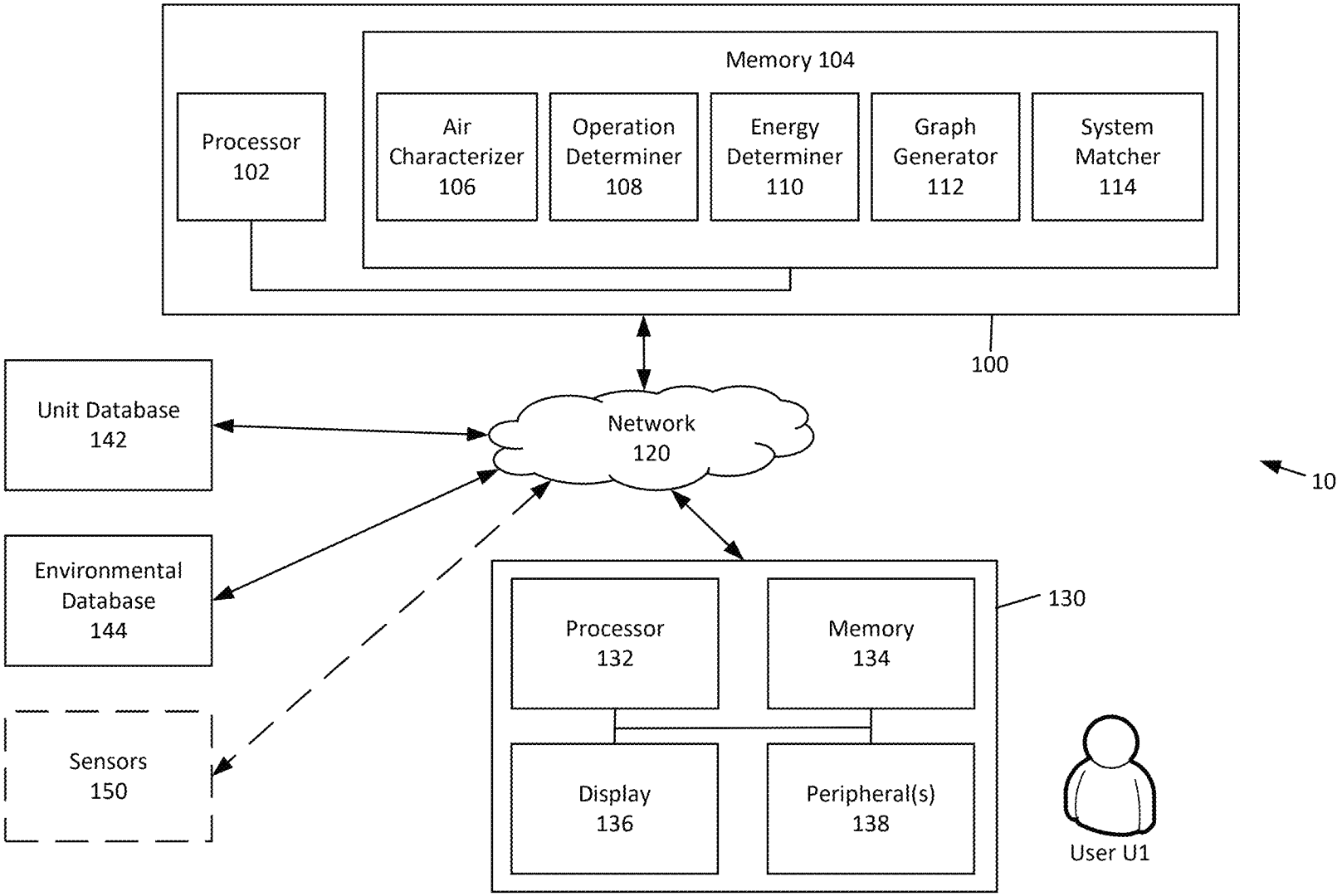
FIG. 1 shows a block diagram of a system for selecting an air processing unit, according to an embodiment.

The present disclosure is generally related to apparatuses and methods for user interface for efficient selection and analysis of heating, ventilation, and air-condition (HVAC) systems (e.g., liquid desiccant HVAC systems, solid desiccant HVAC systems, other desiccant systems). In some implementations, a user (e.g., engineer, designer, user, customer, etc.), via a user device, can provide air characteristics (e.g., temperature, humidity, air flow rate, etc.) associated with a space where an HVAC system (e.g., air processing unit, air conditions systems, etc.) is desired. Based on the air characteristics, a psychrometric chart (also referred to herein as a psychrometric chart, or a psychrometric diagram) can be generated with a representation of the air characteristics and a subset of a plurality of air processing units can be determined. Output data associated with possible outputs of the subset of air processing units can be generated. The output data is used to define a set of regions on the psychrometric chart, where each region from the set of regions is associated with a different air processing unit. The psychrometric chart can then be sent to the user for review.

The user can use the psychrometric chart to determine an air processing unit from the subset of air processing units determined that best matches the user's desired criteria (e.g., cost, energy usage, size, weight, etc.). In some embodiments, the user can directly input changes into the psychrometric chart (e.g., via a graphic user interface (GUI), etc.) based on desired air characteristics. Allowing a user to use the psychrometric chart and a GUI to make informed decisions results in designs that fulfill desired criteria.

Air conditioning systems may perform two functions: first to dehumidify and second to cool a forced air stream. Some known air conditioning systems use vapor compression, which can both cool the incoming air and dehumidify the incoming air by cooling the incoming air below the dew point temperature of the air, thus condensing water. However, given a humid air stream, vapor compression may rely on cooling the air stream to below the air stream's desired delivery temperature to condense the moisture and achieve a low absolute humidity, then, in some implementations, re-heating the air to the air's desired delivery temperature. This moisture condensation process can increase the energy requirement of air conditioners, especially in humid climates. An alternative dehumidification method, known as desiccant dehumidification, can substantially decrease the energy intensity of air conditioning. Desiccant dehumidification systems can use solid or liquid desiccants. While the apparatuses and methods described herein are described as related to systems that use a desiccant, the apparatuses and methods can be used to select any systems for conditioning and/or processing air.

There are generally three categories of air characteristics (e.g., temperature, flow rate, humidity, etc.) that are associated to the function of air conditioning systems, inlet characteristics, supply characteristics, and return characteristics. In some implementations, the air characteristics are set values. In some implementations, the air characteristics are ranges. The inlet conditions are associated with the characteristics of the air entering the air conditioning unit. For example, the inlet conditions can include environmental characteristics (e.g., temperature, flow rate, humidity, etc.). In some embodiments, an inlet characteristic scan be associated with the location (e.g., geographic location, etc.). The supply characteristics are associated with the characteristics of the air exiting the air conditioning unit. For example, the supply characteristics can include the air characteristics that the air processing unit can generate based on the inlet characteristics and/or the outdoor (i.e., ambient) air characteristics. Additionally, the possible supply characteristics can be based off of the return characteristics, which include the air characteristics in the space that receives the output of the air conditioning system.

FIG. 1 shows a block diagram of a system for selecting an air processing unit, according to an embodiment. The system 10 is configured to allow a user U1 to select an air processing unit. The system 10 can include a selection system 100, a user compute device 130, a unit database 142, an environmental database 144, and, optionally, sensors 150, each operatively coupled to one another via a network 120.

The network 120 may be used to facilitate communication between the components of the system 10. For example, the network 120 may facilitate operation between selection system 100, the user compute device 130, the unit database 142, and/or the environmental database 144. The network 120 can be any suitable communications network for transferring data, operating over public and/or private networks. For example, the network 120 can include a private network, a Virtual Private Network (VPN), a Multiprotocol Label Switching (MPLS) circuit, the Internet, an intranet, a local area network (LAN), a wide area network (WAN), a metropolitan area network (MAN), a worldwide interoperability for microwave access network (WiMAX®), an optical fiber (or fiber optic)-based network, a Bluetooth® network, a virtual network, and/or any combination thereof. In some instances, the network 120 can be a wireless network such as, for example, a Wi-Fi or wireless local area network ("WLAN"), a wireless wide area network ("WWAN"), and/or a cellular network. In some instances, the network 120 can be a wired network such as, for example, an Ethernet network, a digital subscription line ("DSL") network, a broadband network, and/or a fiber-optic network. In some instances, the network can use Application Programming Interfaces (APIs) and/or data interchange formats (e.g., Representational State Transfer (REST), JavaScript Object Notation (JSON), Extensible Markup Language (XML), Simple Object Access Protocol (SOAP), and/or Java Message Service (JMS)). The communications sent via the network 120 can be encrypted or unencrypted. In some instances, the communication network 120 can include multiple networks or subnetworks operatively coupled to one another by, for example, network bridges, routers, switches, gateways and/or the like (not shown).

The user compute device 130 can be a device configured to control and/or provide signals to the selection system 100. For example, the user computer device 130 may be used to provide inputs to the selection system 100 regarding present and/or desired air characteristics and/or space information (e.g., location, size, insulation, etc.). In some implementations, the user compute device 130 may be configured to monitor the operation of the selection system 100. For example, the user compute device 130 may display progress and/or results of an air processing unit selection process. The user compute device 130 can include a processor 132, memory 134, display 136, and peripheral(s) 138, each operatively coupled to one another (e.g., via a system bus). In some implementations, the user compute device 130 is associated with (e.g., owned by, accessible by, operated by, etc.) a user U1. The user U1 can be any type of user, such as, for example, an engineer, designer, user, customer, etc.

The processor 132 of the user compute device 130 can be, for example, a hardware based integrated circuit (IC), or any other suitable processing device configured to run and/or execute a set of instructions or code. For example, the processor 132 can be a general-purpose processor, a central processing unit (CPU), an accelerated processing unit (APU), an application specific integrated circuit (ASIC), a field programmable gate array (FPGA), a programmable logic array (PLA), a complex programmable logic device (CPLD), a programmable logic controller (PLC) and/or the like. The processor 132 can be operatively coupled to the memory 134 through a system bus (for example, address bus, data bus and/or control bus).

The memory 134 of the user compute device 130 can be, for example, a random-access memory (RAM), a memory buffer, a hard drive, a read-only memory (ROM), an erasable programmable read-only memory (EPROM), and/or the like. In some instances, the memory 134 can store, for example, one or more software programs and/or code that can include instructions to cause the processor 132 to perform one or more processes, functions, and/or the like. In some implementations, the memory 134 can include extendable storage units that can be added and used incrementally. In some implementations, the memory 134 can be a portable memory (e.g., a flash drive, a portable hard disk, and/or the like) that can be operatively coupled to the processor 132. In some instances, the memory 134 can be remotely operatively coupled with a compute device (not shown). For example, a remote database device can serve as a memory and be operatively coupled to the compute device.

The peripheral(s) 138 can include any type of peripheral, such as an input device, an output device, a mouse, keyboard, microphone, touch screen, speaker, scanner, headset, printer, camera, and/or the like. In some instances, the user U1 can use the peripheral(s) 138 to input present (e.g., inlet) and/or desired (e.g., supply) air characteristics. For example, the user U1 may type the command using a keyboard included in peripheral(s) 138 to input the desired air characteristics and/or select an air processing unit with a mouse included in peripherals(s) 138 to indicate the desired air processing unit.

The display 136 can be any type of display, such as, for example, a Cathode Ray tube (CRT) display, a Liquid Crystal Display (LCD), a Liquid Emitting Diode (LED) display, an Organic Light Emitting Diode (OLED) display, and/or the like. The display 136 can be used for visually displaying information (e.g., psychrometric graph, a GUI etc.) to user U1. For example, display 136 can display the possible outputs of air processing units on a psychrometric graph. In some embodiments, the outputs displayed on the display 136 can be interacted with (e.g., by the peripheral(s) 138) to allow a user to modify (e.g., expand, change, remove, etc.) portions of the output. In some implementations, the peripheral(s) 138 can be integrated with the display 136. For example, the display 136 can be a touch screen display configured to receive inputs from a user. Examples of an output that can be displayed by the display 136 are shown in FIGS. 5-11.

The unit database 142 and the environmental database 144 can be any devices or services (e.g., hard-drive, server, cloud storage service, etc.) configured to store signals, information, commands, air processing information (e.g., algorithms), and/or data. The unit database 142 and the environmental database 144 may receive and store signals, information and/or data from the other components of the system 10. The unit database 142 and the environmental database 144 may include a local storage system associated with the selection system 100, such as, for example, a server, a hard-drive, and/or the like or a cloud-based storage system. In some implementations, the unit database 142 and/or the environmental database 144 may include a combination of local storage systems and cloud-based storage systems.

The unit database 142 is configured to store information associated with various air processing units. In some implementations, the unit database 142 may be associated with one manufacturer and include air processing units from one manufacturer. In some implementations, the unit database 142 may be associated with multiple manufacturers and can include air processing units from the multiple manufacturers. In some implementations, the information associated with the air processing units can include values and/or algorithms associated with inlet characteristics and/or supply characteristics associated with the air processing units. For example, the information can include inlet characteristics that an air processing unit is configured to operate in and/or supply characteristics that an air processing unit is configured to produce.

The environmental database 144 can be configured to store air characteristics related to a location. For example, the environmental database 144 can store weather (e.g., temperature, humidity, air density, etc.) information association with a location. The weather information can include weather information at a certain date or can be a distribution of weather information during the entire year. In some embodiments, the environmental database 144 can be updated to provide updated weather information.

The sensors 150 may include sensors configured to measure air characteristics, air processing unit performance and output, heater performance and output, energy usage, and/or the like. For example, the sensors can be configured to measure the inlet air characteristics, supply air characteristics, return air characteristics, heater characteristics, energy usage, and/or the like. In some implementations, the sensors 150 may be associated with a location. For example, the sensors 150 may be configured to measure the air characteristics at a particular location (e.g., temperature, humidity, elevation, etc.). In some implementations, the sensors 150 may be associated with an air processing unit. For example, the sensors 150 may be configured to measure inlet air characteristics and supply air characteristics. In some implementations, the sensors 150 may be associated with a space. For example, the sensors 150 may measure the return air characteristics and the effect of the air processing unit on the space. In some implementations, the sensors 150 are optional.

The selection system 100 is configured to generate psychrometric graphs and candidate air processing units for selection of an air processing unit based on inputs received from the user U1 via the user compute device 130. The selection system 100 can include a processor 102 and a memory 104, each operatively coupled to one another (e.g., via a system bus). The memory 104 can include and/or store an air characterizer 106, an operation determiner 108, an energy determiner 110, a graph generator 112, and a system matcher 114. In some implementations, the user compute device 130 is associated with (e.g., owned by, accessible by, operated by, etc.) an organization, and the selection system 100 is associated with (e.g., owned by, accessible by, operated by, etc.) the same organization. In some implementations, the user compute device 130 is associated with (e.g., owned by, accessible by, operated by, etc.) a first organization, and the selection system 100 is associated with (e.g., owned by, accessible by, operated by, etc.) a second organization different than the first organization. In some implementations, the selection system 100 and the user compute device 130 may be components of the same computing system.

The processor 102 of the selection system 100 can be, for example, a hardware based integrated circuit (IC), or any other suitable processing device configured to run and/or execute a set of instructions or code. For example, the processor 102 can be a general-purpose processor, a central processing unit (CPU), an accelerated processing unit (APU), an application specific integrated circuit (ASIC), a field programmable gate array (FPGA), a programmable logic array (PLA), a complex programmable logic device (CPLD), a programmable logic controller (PLC) and/or the like. The processor can be operatively coupled to the memory 104 through a system bus (e.g., address bus, data bus, and/or control bus).

The memory 104 of the of the selection system 100 can be, for example, a random-access memory (RAM), a memory buffer, a hard drive, a read-only memory (ROM), an erasable programmable read-only memory (EPROM), and/or the like. In some instances, the memory 104 can store, for example, one or more software programs and/or code that can include instructions to cause the processor 102 to perform one or more processes, functions, and/or the like. In some implementations, the memory 104 can include extendable storage units that can be added and used incrementally. In some implementations, the memory 104 can be a portable memory (e.g., a flash drive, a portable hard disk, and/or the like) that can be operatively coupled to the processor 102. In some instances, the memory 104 can be remotely operatively coupled with a compute device (not shown). For example, a remote database device can serve as a memory and be operatively coupled to the compute device.

The selection system 100 can receive various inputs from the user U1. The inputs can include air characteristics and/or information associated with air characteristics. For example the inputs can include a location (e.g., location where an air processing unit will be installed, etc.), inlet air characteristics (e.g., flow rate, temperature, etc.), desired supply characteristics (e.g., flow rate, temperature, supply humidity, supply dry bulb temperature, etc.), space characteristics (e.g., information associated with the space where the supply air will be delivered), return characteristics, and/or the like. In some implementations, the location can include location details such as elevation, cooling dry bulb, cooling mean coincident wet bulb (MCWB), cooling mean coincident dew point (MCDW), cooling mean coincident humidity ratio (MCHR), winter dry bulb, winter wet bulb, winter dew point, winter humidity ratio, and/or the like. In some implementations, the inputs can include additional design considerations, such as cooling, dehumidification, etc. In some implementations, the input can include an indication of how the air characterizer 106 may be configured to calculate other air characteristics. For example, the input can include an indication of how humidity is desired to be calculated. For example, humidity can be calculated based on humidity ratio, wet bulb, or dew point. In some implementations, the input can include an indication of whether it is desirable for return air to be used in the air processing unit. In some implementations, the inputs can include an indication of whether it is desirable for energy recovery to be used by the air processing unit. In some implementations, the user U1 can input the inputs via a GUI. For example, the GUI can include data fields for the user U1 to complete. An example of the GUI can be seen in FIGS. 5 and 6.

The air characterizer 106 is configured to receive the inputs associated with the air characteristics and/or the information. In some implementations, such as when the air characterizer 106 receives an input that includes a location, the air characterizer 106 may be configured to receive air characteristics associated with the location from the environmental database 144. For example, the environmental database 144 can include a lookup table that can include air characteristic or location information associated with the location. For example, the air characterizer 106 can include indications of elevation, cooling dry bulb, cooling mean coincident wet bulb (MCWB), cooling mean coincident dew point (MCDW), cooling mean coincident humidity ratio (MCHR), winter dry bulb, winter wet bulb, winter dew point, winter humidity ratio, and/or the like. In some implementations, the input can include information regarding whether a heater is desired for the air processing system. For example, the user U1 can indicate if no heat is desired or if a heater is desired. In some implementations, the user U1 can indicate the type of heater that is desired (e.g., gas heater, electric heater, etc.). The air characterizer 106 may use the heater information to determine the air characteristics.

Based on the air characteristics received in the input or from the environmental database 144, the air characterizer 106 is configured to determine and/or calculate various air characteristics associated with the inlet characteristics. For example, if the input includes information associated with elevation, the air characterizer 106 can be configured to determine an air density based on the elevation. As another example, the air characterizer 106 can be configured to calculate additional air characteristics such as, for example, humidity, dry bulb temperature, and/or the like based on the air characteristics in the inputs. In some implementations, the air characterizer 106 may be configured to receive air characteristics from the sensors 150. For example, if the inputs include a location, the air characterizer 106 can receive air characteristics associated with the location from the sensors 150. In some implementations, the air characterizer 106 can receive return characteristics from sensors 150 configured to measure air characteristics in a space.

The operation determiner 108 is configured to determine potential output (e.g., supply air characteristics) of air processing units. The operation determiner 108 may receive information associated with air processing units from the unit database 142. In some implementations, the information associated with the air processing units can include function, features (e.g., heater, energy recovery, etc.) potential outputs, and/or the like. In some implementations, the operation determiner 108 can be configured to filter out certain air processing units that do not satisfy information indicated in the inputs received from the user U1. For example, the operation determiner 108 can filter out air processing units that do not accommodate or provide sufficient air flow, do not meet the desired supply air conditions, do not include a heater, do not include a desired type of heater, do not use return air, or do not include an energy recovery system.

The operation determiner 108 can be configured to determine the potential output for the air processing units based on the inlet characteristics. For example, the potential output can include an array of potential outputs that are based on the inlet characteristics. The potential output can indicate how each air processing unit may perform during operation given the inlet characteristics. In some implementations, the potential output can be a function of the inlet characteristics, allowing the inlet characteristics to be adjusted to adjust the potential output. In some implementations, the potential output can be adjusted to determine what inlet characteristics are desired for a desired supply characteristic.

In some implementations, the operation determiner 108 can be configured to change desired supply characteristics based on received parameters from the user U1. For example, the operation determiner 108 can be configured to change the desired supply characteristics based a parameter indicating that reducing energy usage is desirable. The operation determiner 108 can then change at least one of supply temperature, supply, humidity, supply flow rate, and/or the like to reduce projected energy usage. In some implementations, the operation determiner 108 can receive energy usage information from the energy determiner 110. In some implementations, the received parameters can include size, cost, energy usage, features, and/or the like.

The energy determiner 110 is configured to determine the energy used (e.g., typical annual energy usage) by the air processing units during operation. In some implementations, determining the energy used by the air processing units can be based on desired supply characteristics, inlet characteristics, and/or the like. In some implementations, the energy usage can be determined separately for summer conditions (e.g., no heater used) and for winter conditions (e.g., when a heater is used). In some implementations, the energy usage can be determined for various operating modes such as cooling, dehumidifying, and/or heating. In some implementations, determining the energy usage can include using an energy recovery system. The energy usage can be used to compare different air processing units and for supporting the user U1 in selecting an air processing unit. In some implementations, the energy determiner 110 may be configured to receive energy usage data from the environmental database 144. In some implementations, the energy determiner 110 may be configured to receive energy usage data from sensors 150.

The graph generator 112 is configured to generate a psychrometric graph with a representation of the air characteristics indicated in the inputs or as determined by the air characterizer 106. The representations can include outside air (e.g., inlet characteristics), target supply characteristics, return characteristics, energy recovery system characteristics, heater characteristics, and/or the like. Additionally, the graph generator 112 is configured to generate regions that are associated with the potential outputs of the air processing units. The regions are plotted on the psychrometric graph to indicate the capabilities of the air processing units. In some implementations, the graph generator 112 is configured to generate an output representing a heater on the psychrometric graph. In some implementations, the user U1 can provide inputs to the psychrometric graph that move the representation to new positions. For example, the user U1 can move the desired air characteristic representation to a new position and the graph generator 112 can determine the characteristic in the second position. Examples of psychrometric graphs are shown and further discussed with reference to FIGS. 7-11.

In some implementations, the graph generator 112 may be configured to plot air processing unit performance, after installation, based on measurements from sensors 150 configured to measure the performance of the air processing unit. For example, the graph generator 112 may be configured to plot the inlet characteristics, supply characteristics, return characteristics, and other information associated with the performance of the air processing unit. In some implementations, the performance may be plotted along with the regions associated with potential outputs. Plotting performance may allow for the user U1 to determine if the air processing unit is performing as expected, allowing for the user U1 to monitor for potential issues with the air processing unit. For example, the user U1 can determine if the operation of the air processing unit is within or outside of an excepted range of the air processing unit. As another example, the user U1 can use the comparison of the expected and actual performance to perform Measurement & Verification (M&V) of the unit for various purposes, including, for example, supporting financial investments or utility and/or other energy saving agreements.

The system matcher 114 is configured to determine which air processing units satisfy desired air characteristics as indicated in the inputs from the user U1 to define a subset of air processing units. For example, the system matcher 114 can determine a subset of air processing units that satisfy a supply characteristic based on the given inlet characteristics. In some implementations, the user U1 can change the desired air characteristics to change the subset of air processing units. In some implementations, the system matcher 114 is configured to determine a candidate air processing unit based on a metric indicated in the input. The metric can include, for example, energy usage, cost, and/or the like. The system matcher 114 can then compare the subset of air processing units and determine a candidate air processing unit that satisfies the metric. For example, the system matcher 114 can determine a least expensive air processing unit from the subset of air processing units or an air processing unit that is the most energy efficient from the subset of air processing units. In some implementations, the graph generator 112 is configured to generate a region for the outputs of the subset of air processing units and not for other air processing units.

Figure 2:
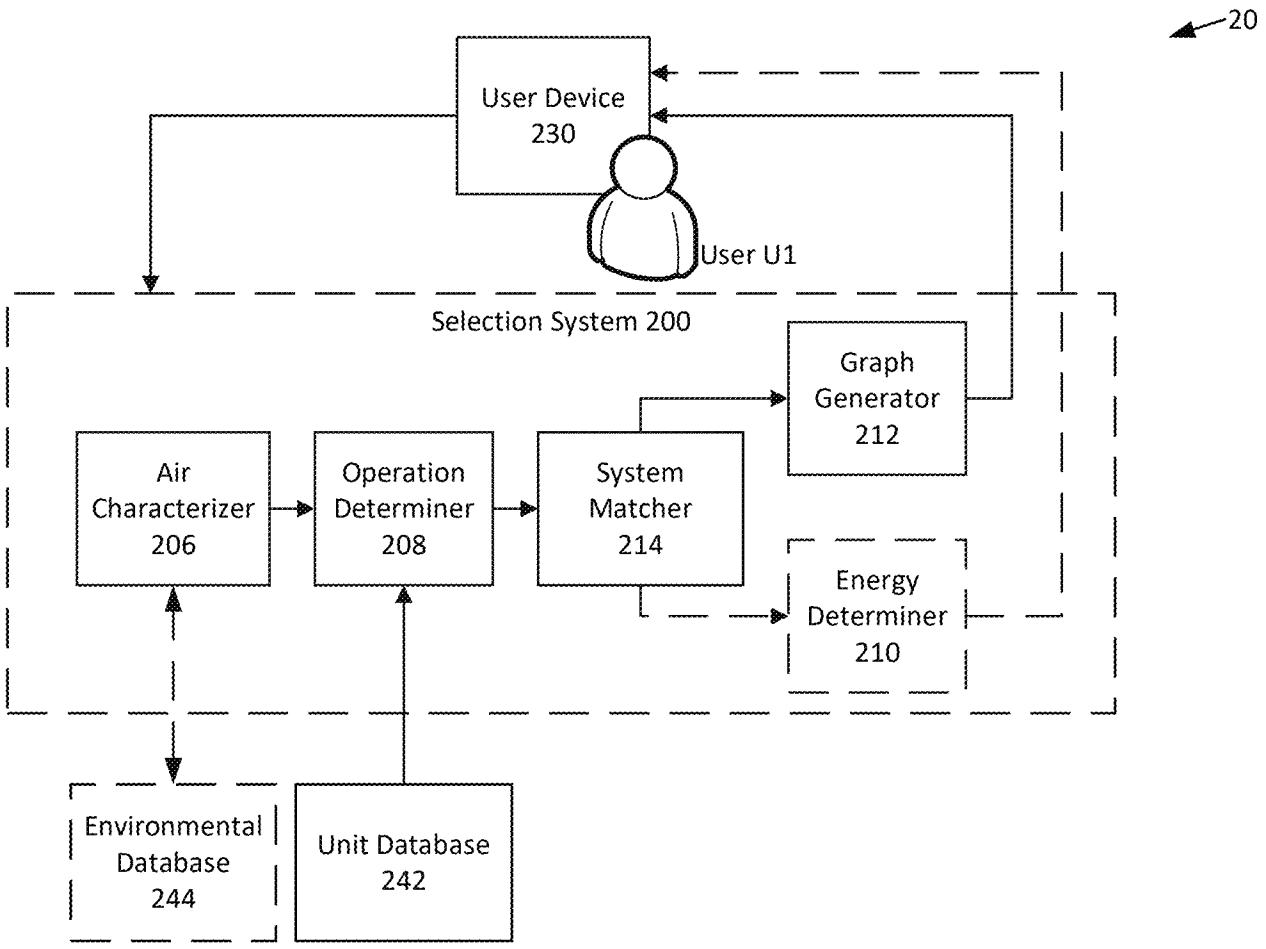
FIG. 2 shows a block diagram of a workflow for selecting an air processing unit, according to an embodiment.

FIG. 2 shows a block diagram of a workflow 20 for selecting an air processing unit, according to an embodiment. The workflow 20 may be executed by the system 10 of FIG. 1. The workflow 20 includes a user device 230 (e.g., functionally and/or structurally similar to the user compute device 130 of FIG. 1) associated with the user U1, a selection system 200 (e.g., structurally and/or functionally similar to the selection system 100 of FIG. 1) including an air characterizer 206 (e.g., structurally and/or functionally similar to the air characterizer 106 of FIG. 1), an operation determiner 208 (e.g., structurally and/or functionally similar to the operation determiner 108 of FIG. 1), a graph generator 212 (e.g., structurally and/or functionally similar to the graph generator 112 of FIG. 1), an energy determiner 210 (e.g., functionally and/or structurally similar to the energy determiner 110 of FIG. 1), and a system matcher 214 (e.g., functionally and/or structurally similar to the system matcher 114 of FIG. 1), an environmental database 244 (e.g., functionally and/or structurally similar to the environmental database 144 of FIG. 1), and a unit database 242 (e.g., functionally and/or structurally similar to the unit database 142 of FIG. 1).

The workflow 20 includes the user U1 inputting inputs into the selection system 200 via the user device 230. In some implementations, the user U1 may enter the inputs, via the user device 230, into the selection system 200 by using a GUI (e.g., on a website, in an application, etc.) associated with the selection system 200. The inputs can include air characteristics and/or information associated with air characteristics. For example the inputs can include a location (e.g., location where an air processing unit will be installed, etc.), inlet air characteristics (e.g., flow rate, temperature, etc.), desired supply characteristics (e.g., flow rate, temperature, supply humidity, supply dry bulb temperature, etc.), space characteristics (e.g., information associated with the space where the supply air will be delivered), return characteristics, and/or the like. In some implementations, the location can include location details such as, for example, elevation, cooling dry bulb, cooling mean coincident wet bulb (MCWB), cooling mean coincident dew point (MCDW), cooling mean coincident humidity ratio (MCHR), winter dry bulb, winter wet bulb, winter dew point, winter humidity ratio, and/or the like. The inputs, in some implementations, can include desired air characteristics, such as, for example, supply characteristics (e.g., supply humidity, supply dry bulb temperature, etc.). In some implementations, the input can include indications of desired features such as, for example, a heater, type of heater, whether return air is used, or if an energy recovery system is used. In some implementations, the GUI can lead the user U1 through filling out the inputs. In some implementations, the GUI can issue a notification to the user U1 if the input is filled out in a way that may produce an error for selecting an air processing unit. For example, if the temperature is outside of an operational range, the GUI can issue a notification to the user U1.

The air characterizer 206 receives the inputs from the user device 230 and is configured to determine air characteristics based on the inputs from the user device 230. In some implementations, the air characterizer 206 calculates additional air characteristics based on the air characteristics included in the inputs. For example, if the elevation is given, the air characterizer 206 may be configured to determine air density. In some implementations, such as when the inputs indicate a location and no or missing location information, the air characterizer 206 can be configured to send a signal to the environmental database 244 requesting information associated with the location and to receive the requested information. In some implementations, the air characterizer 206 may be configured to determine the desired inlet air characteristics. For example, determining the desired inlet air characteristics can be based on a location where the air processing unit may be located (e.g., typical inlet air characteristics for that location).

The operation determiner 208 receives the air characteristics from the air characterizer 206, the inputs from the user device 230, and a list of air processing units from the unit database 242. The unit database 242 can include air processing units associated with a single manufacturer or can include air processing units from multiple manufacturers. In some implementations, the operation determiner 208 may be configured to filter out systems that do not meet criteria indicated in the inputs. The operation determiner 208 is configured to determine output data associated with the operational output of the air processing units based on the air characteristics. In some implementations, the output data can include an array of outputs (e.g., supply characteristics) from the air processing units.

The system matcher 214 is configured to receive the output from the operation determiner 208 and to define a subset of air processing units that satisfy the desired supply characteristics. For example, the subset of air processing units can include the subset of air processing units that include the desired air characteristic. In some implementations, the system matcher 214 may define the subset of air processing units prior to the graph generator 212 generating the psychrometric graph. In some implementations, the system matcher 214 is configured to generate a candidate air processing unit based on a metric such as energy usage, cost, etc. In some implementations, the system matcher 214 can calculate parameters for each system from the subset of air processing units. For example, if a user inputs the supply dry bulb temperature, the air characterizer 206 can determine and/or calculate a range (e.g., from a minimum to a maximum) of achievable humidity parameter for each air processing unit from the subset of air processing units. For another example, if a user inputs the supply humidity parameter, the air characterizer can determine and/or calculate a range (e.g., from a minimum to a maximum) of achievable dry bulb temperature for each air processing unit from the subset of air processing units.

The graph generator 212 is configured to receive the air characteristics, inputs from the user device 230, and the output data from the system matcher 214. The graph generator 212 is configured to generate a psychrometric graph that includes information that the user U1 may desire to select an air processing unit. The graph generator 212 is configured to generate, on the psychrometric graph, representations of the air characteristics. For example, the representations can include representations of the inlet characteristics, desired supply characteristics, and/or return characteristics. The graph generator 212 is also configured to generate regions on the psychrometric chart that are associated with the output data generated by the operation determiner 208. The regions indicate, on the psychometric graph, the possible outputs of the air processing units. The regions allow for the outputs of the air processing units to be compared in relation to the representations on the psychrometric graph. In some implementations, the graph generator 212 can be configured to generate representations associated with the operation of one or more heater on the psychrometric graph. In some implementations, a subset of the air processing units that satisfy the desired supply characteristics are graphed on the psychrometric graph. In some implementations, the graph generator 212 is configured to send the psychrometric graph and the subset of air processing units to the user device 230 for review by the user U1. In some implementations, the user U1 may be allowed to move the representations on the psychrometric graph from a first position to a second position. The air characterizer 206 can determine the air characteristics associated with the second position and the system matcher 214 can define a new subset of air processing units that satisfy the air characteristic associated with the second position.

The energy determiner 210 is configured to determine the energy usage for the air processing units. In some implementations, the energy determined 210 may be configured to determine energy usage for different points in the region associated with the outputs of the air processing units. In some implementations, the energy determiner 210 can generate average energy values for each of the air processing units based on previous usage data and/or desired output. In some embodiments, the use of the energy determiner 210 is optional. In some implementations, the energy determiner 210 can send the energy usage information to the user device 230 for review by the user U1. In some implementations, the energy determiner 210 may generate energy usage information when the user U1 indicates that energy usage is desired.

While shown in FIG. 2 as occurring before the graph generator 212 and/or the energy determiner 210, in some implementations the system matcher 214 can be executed after the graph generator 212 and the energy determiner 210. For example, in such implementations, the system matcher 214 can define a subset of air processing units that satisfy the desired supply characteristics after the graph generator 212 generates the graph and/or after the energy determiner 210 determines energy usage for potential air processing units.

Figure 3:
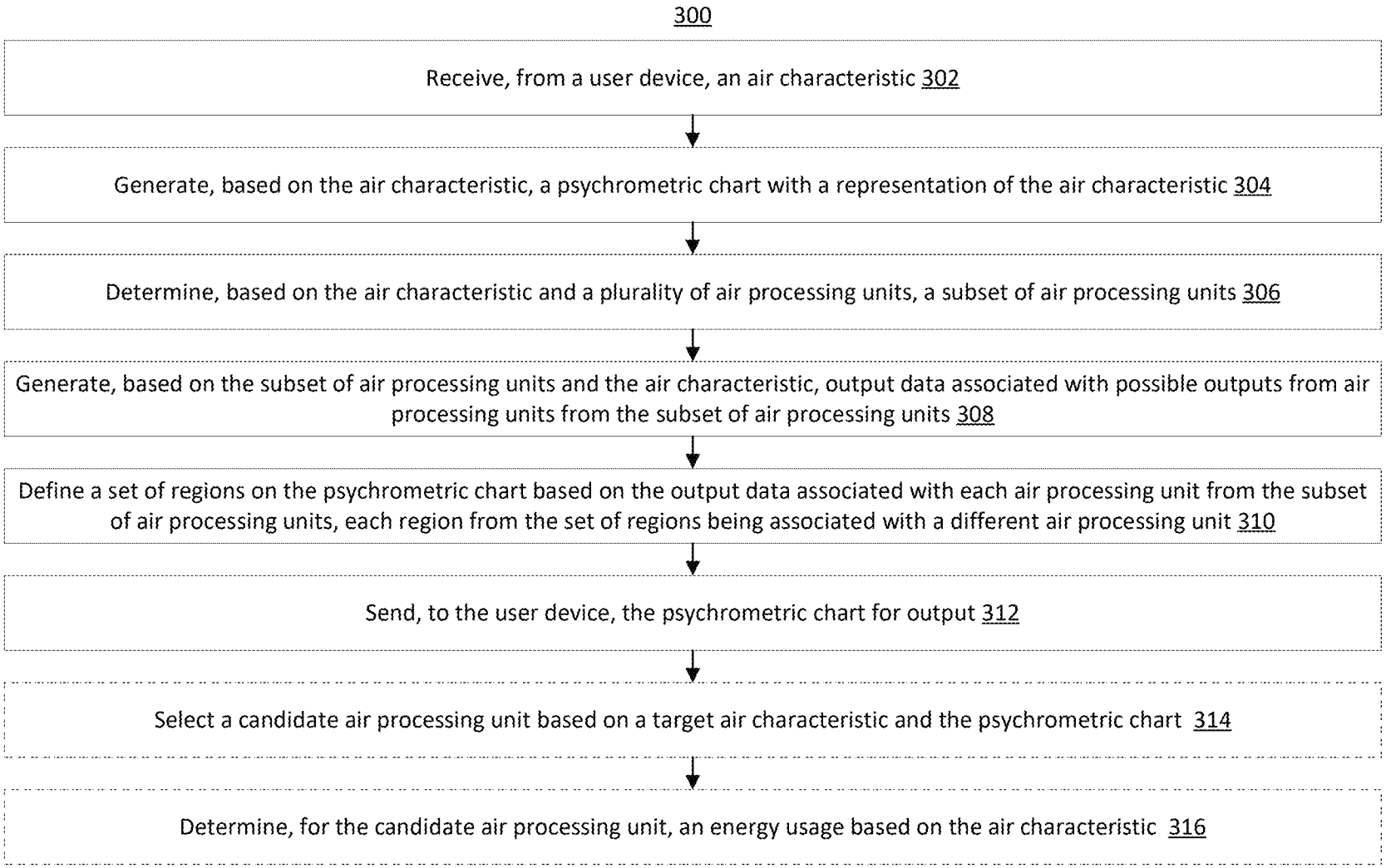
FIG. 3 shows a flow chart for a method for generating a psychrometric chart, according to an embodiment.

FIG. 3 shows a flow chart for a method 300 for generating a psychrometric chart, according to an embodiment. The method 300 includes receiving, from a user device, an air characteristic, at 302; generating, based on the air characteristic, a psychrometric chart with a representation of the air characteristic, at 304; determining, based on the air characteristic and a plurality of air processing units, a subset of air processing units, at 306; generating, based on the subset of air processing units and the air characteristic, output data associated with possible outputs from air processing units from the subset of air processing units, at 308; defining a set of regions on the psychrometric chart based on the output data associated with each air processing unit from the subset of air processing units, each region from the set of regions being associated with a different air processing unit, at 310; sending, to the user device, the psychrometric chart for output, at 312; optionally selecting a candidate air processing unit based on a target air characteristic and the psychrometric chart, at 314; and optionally determining, for the candidate air processing unit, an energy usage based on the air characteristic, at 316. The method 300 can be executed by a system such as the system 10 of FIG. 1.

At 302, an air characteristic is received from a user device. The user device can be associated with a user. In some implementations, the user can be an engineer, designer, user, customer, and/or the like. In some implementations, the user may input the air characteristic into the user device via a GUI. In some implementations, the air characteristic can include a desired supply characteristic, a location, an inlet characteristic, and/or the like. In some implementations, the air characteristic can be processed to generate additional information associated with the air characteristics.

At 304, based on the air characteristic, a psychrometric chart is generated with a representation of the air characteristic. The representation of the psychrometric chart can include a point, a region, and/or the like representing the values indicated by the air characteristic. In some implementations, a second air characteristic can be received from the user device, and a representation of the second air characteristic can be generated on the psychrometric chart. In some implementations, the representation(s) can correspond to at least one of inlet characteristics, desired supply characteristics, energy return system characteristics, return characteristics, outdoor air (i.e., ambient) characteristics, and/or the like.

At 306, based on the air characteristics and a plurality of air processing units, a subset of air processing units is determined. In some implementations, the plurality of air processing units and associated information is stored in a unit database, such as the unit database 142 of FIG. 1 and/or the unit database 242 of FIG. 2. Determining the subset of air processing units can include determining which of the air processing units from the plurality of air processing units satisfy the air characteristic. For example, if the air characteristic is a desired flow rate, the subset of air processing units is a subset of air processing units that can provide the desired flow rate. In some implementations, such as when a second air characteristic is received, the subset of air processing units can be determined as the air processing units from the plurality of air processing units that additionally satisfy the second air characteristic.

At 308, based on the subset of air processing units and the air characteristic, output data associated with possible outputs from air processing units from the subset of air processing units is generated. The output data is generated for each air processing unit from the subset of air processing units. In some implementation, such as when the air characteristic includes inlet characteristics, the output data is generated to represent possible outputs of the air processing units with the received inlet characteristics. In some implementations, the output data is associated with the supply characteristics. In some implementations, the output data is an array of possible outputs from each of the air processing units form the subset of the air processing unit. In some implementations, the air characteristic can include characteristics of the supply such as the supply dry bulb temperature and/or the supply humidity. In some implementations, the supply dry bulb temperature (e.g., as input by a user) can be used to determine and/or calculate a range of achievable humidity for each air processing unit from the subset of air processing units. In some implementations, the supply humidity (e.g., as input by a user) can be used to determine and/or calculate a range of achievable dry bulb temperature for each air processing unit from the subset of air processing units.

At 310, a set of regions on the psychometric chart is defined based on the output data associated with each air processing unit from the subset of air processing units, each region from the set of regions being associated with a different air processing unit. The regions provide a visualization of the possible outputs of the subset of air processing units in relation to the air characteristic. At 312, the psychrometric chart is sent to the user device for output. The psychrometric chart can then be displayed to a user who can select an air processing unit based on the psychrometric chart. In some implementations, the user can indicate a change to the air characteristic on the psychrometric chart and the method 300 returns to 302 to recalculate the output data and regenerate the psychrometric chart based on the change to the air characteristic.

At 314, a candidate air processing unit is selected based on a target air characteristic and the psychrometric chart. In some implementations, the target air characteristic can be a user defined air characteristic that is desired for the candidate air processing unit. In some implementations, information on the candidate air processing unit can be sent to the user device for display to the user. At 316, an energy usage for the candidate air processing unit is optionally determined based on the air characteristic. The energy usage is associated with how much energy each air processing unit of the subset of air processing units uses during operation.

In some implementations, after the candidate air processing unit is installed or another air processing unit from the subset of air processing units is installed, the performance of the installed air processing unit can be monitored by sensors, such as the sensor 150 of FIG. 1. In some implementations, the sensor data from the sensor can be plotted on the psychrometric graph, which can then be sent to user for review. The user can then review the performance of the air processing unit to determine if the air processing unit is functioning as predicted in the output data.

Figure 4:
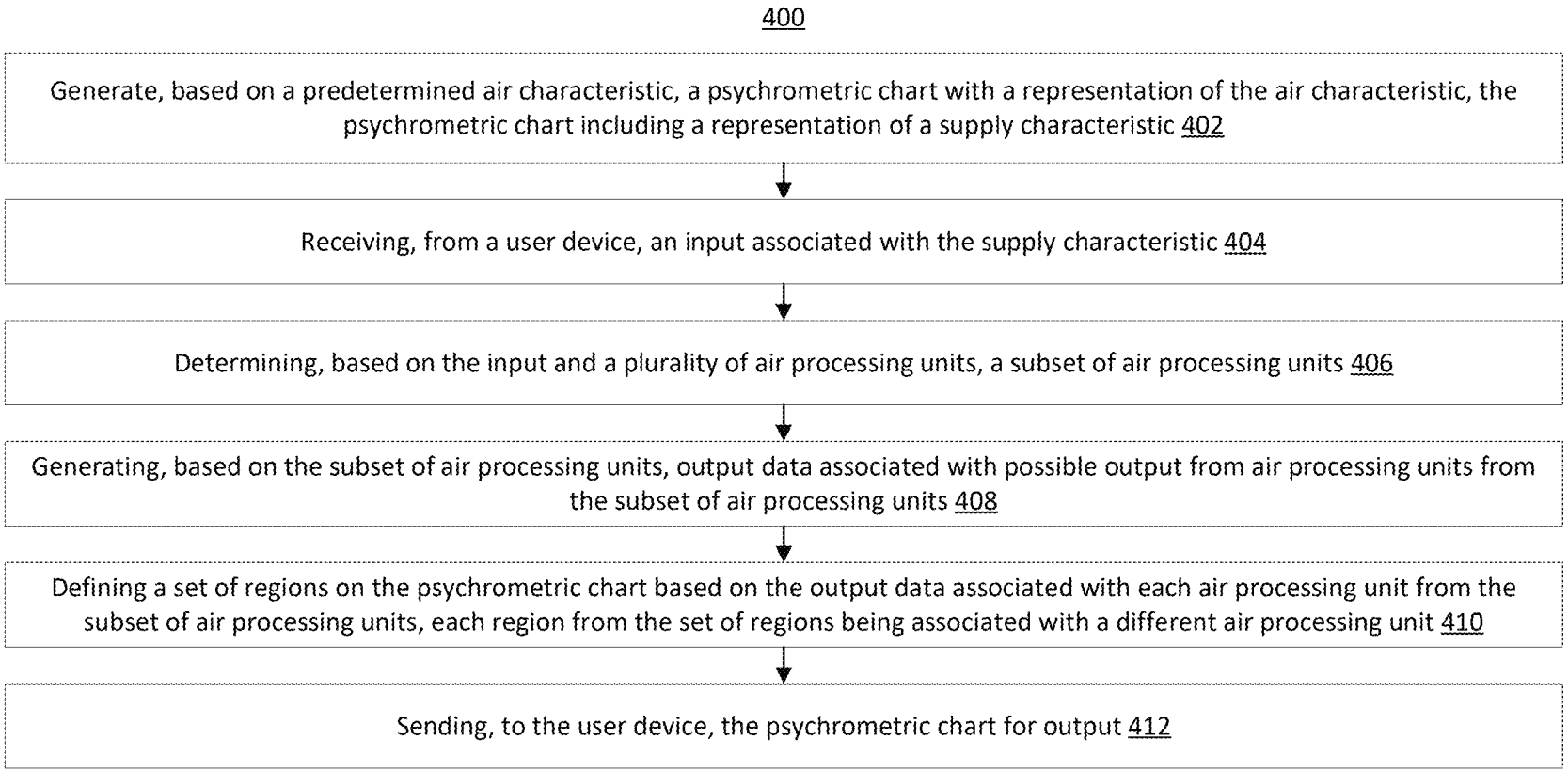
FIG. 4 shows a flow chart for another method for generating a psychrometric chart, according to an embodiment.

FIG. 4 shows a flow chart for another method 400 for generating a psychrometric chart, according to an embodiment. The method 400 includes generating, based on a predetermined air characteristic, a psychrometric chart with a representation of the air characteristic, the psychrometric chart including a representation of a supply characteristic, at 402; receiving, from a user device, an input associated with the representation of the supply characteristic, at 404; determining, based on the input and a plurality of air processing units, a subset of air processing units, at 406; generating, based on the subset of air processing units, output data associated with possible output from air processing units from the subset of air processing units, at 408; defining a set of regions on the psychrometric chart based on the output data associated with each air processing unit from the subset of air processing units, each region from the set of regions being associated with a different air processing unit, at 410; and sending, to the user device, the psychrometric chart for output, at 412. The method 400 can be executed by a system such as the system 10 of FIG. 1.

At 402, a psychometric chart is generated based on a predetermined air characteristic, the psychometric chart including a representation of the air characteristic and a representation of a supply characteristic. The representations can include a dot, a region, or other indication of the value of the air characteristic and/or the supply characteristic. In some implementations, the air characteristic can be associated with the inlet characteristics, return characteristics, and/or the like. In some implementations, the supply characteristic is a desired supply characteristic. In some implementations, the air characteristic and/or the supply characteristic may be previously received from a user device. In some implementations, the psychometric chart can be sent to a user device for review by a user.

At 404, an input from the user device is received. The input is associated with the supply characteristic. The input can be, in some implementations, an indication that the desired supply characteristic is changed. In some implementations, the input can be an indication that the user has moved the representation of the supply characteristic from a first position to a second position. The supply characteristic associated with the second position can then be determined. At 406, a subset of air processing units can be determined based on the input and a plurality of air processing units. In some implementations, the plurality of air processing units and associated information is stored in a unit database, such as the unit database 142 of FIG. 1 and/or the unit database 242 of FIG. 2. Determining the subset of air processing units can include determining which of the air processing units from the plurality of air processing units satisfy the supply characteristic indicated in the input.

At 408, based on the subset of air processing units, output data associated with possible outputs from air processing units from the subset of air processing units is generated. In some implementations, such as when the air characteristic includes inlet characteristics, the output data is generated to represent possible outputs of the air processing units with the received inlet characteristics. In some implementations, the output data is associated with the supply characteristics. In some implementations, the output data is an array of possible outputs from each of the air processing units from the subset of the air processing unit.

At 410, a set of regions on the psychometric chart is defined based on the output data associated with each air processing unit from the subset of air processing units, each region from the set of regions being associated with a different air processing unit. The regions provide a visualization of the possible outputs of the subset of air processing units in relation to the air characteristic. At 412, the psychrometric chart is sent to the user device for output. The psychrometric chart can then be displayed to a user who can select an air processing unit based on the psychrometric chart.

Figure 5:
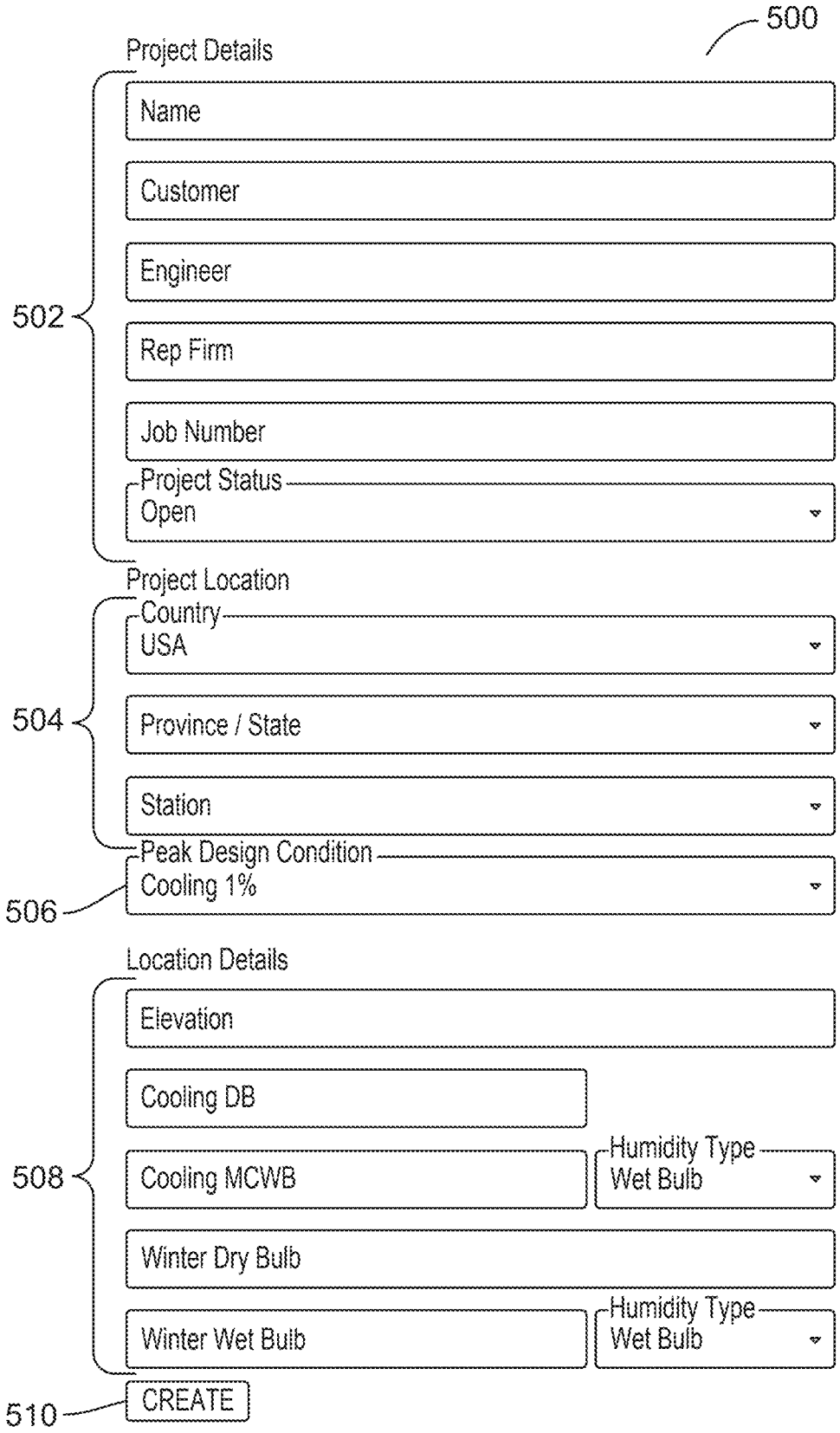
FIG. 5 shows an example of a setup interface for a selection system, according to an embodiment.

FIG. 5 shows an example of a setup interface 500 for a selection system, according to an embodiment. The setup interface 500 can be shown on a user device, such as the user compute device 130 of FIG. 1 and/or the user device 230 of FIG. 2. In some implementations, the setup interface 500 is shown on a display, such as the display 136 of FIG. 1 and can be interacted with by a user via peripheral(s) such as the peripheral(s) 138 of FIG. 1. The data fields of the setup interface 500 can be updated (e.g., changed) to include information entered by the user via the peripheral(s). The setup interface 500 includes identifying information fields 502, location fields 504, a design condition field 506, location detail fields 508, and a submission button 510.

The identifying information fields 502 allow a user to keep track of the results and with which project the results are associated. The identifying information fields 502 include data fields in which the user can enter information that is associated with identifying information related to a project (e.g., construction project, HVAC project, etc.). The identifying information fields 502 can include fields for naming the project, customer information, engineer information, representative firm information, a job number, and a project status. The location fields 504 allow for a user to input the location of the project. For example, the location fields 504 can include the country, province/state, station, and/or the like. The design condition field 506 allows for a user to enter a peak design condition such as a cooling percentage or a dehumidification percentage. The location detail fields 508 allow for a user to enter specific information regarding a location. For example, the location detail fields 508 can include data fields for entering elevation, cooling dry bulb, cooling MCWB, cooling MCDP, cooling MCHR, winter dry bulb, winter wet bulb, winter dew point, winter humidity ratio, and/or the like. In some implementations, the location detail fields can be automatically populated based on information stored in an environmental database, such as the environmental database 144 of FIG. 1 and/or the environmental database 244 of FIG. 2. In some implementations, the location fields 504 and the design condition field 506 can be used to pre-populate the location detail fields 508. The submission button 510 can be used to submit the entered information and continue to the next page.

Figure 6:
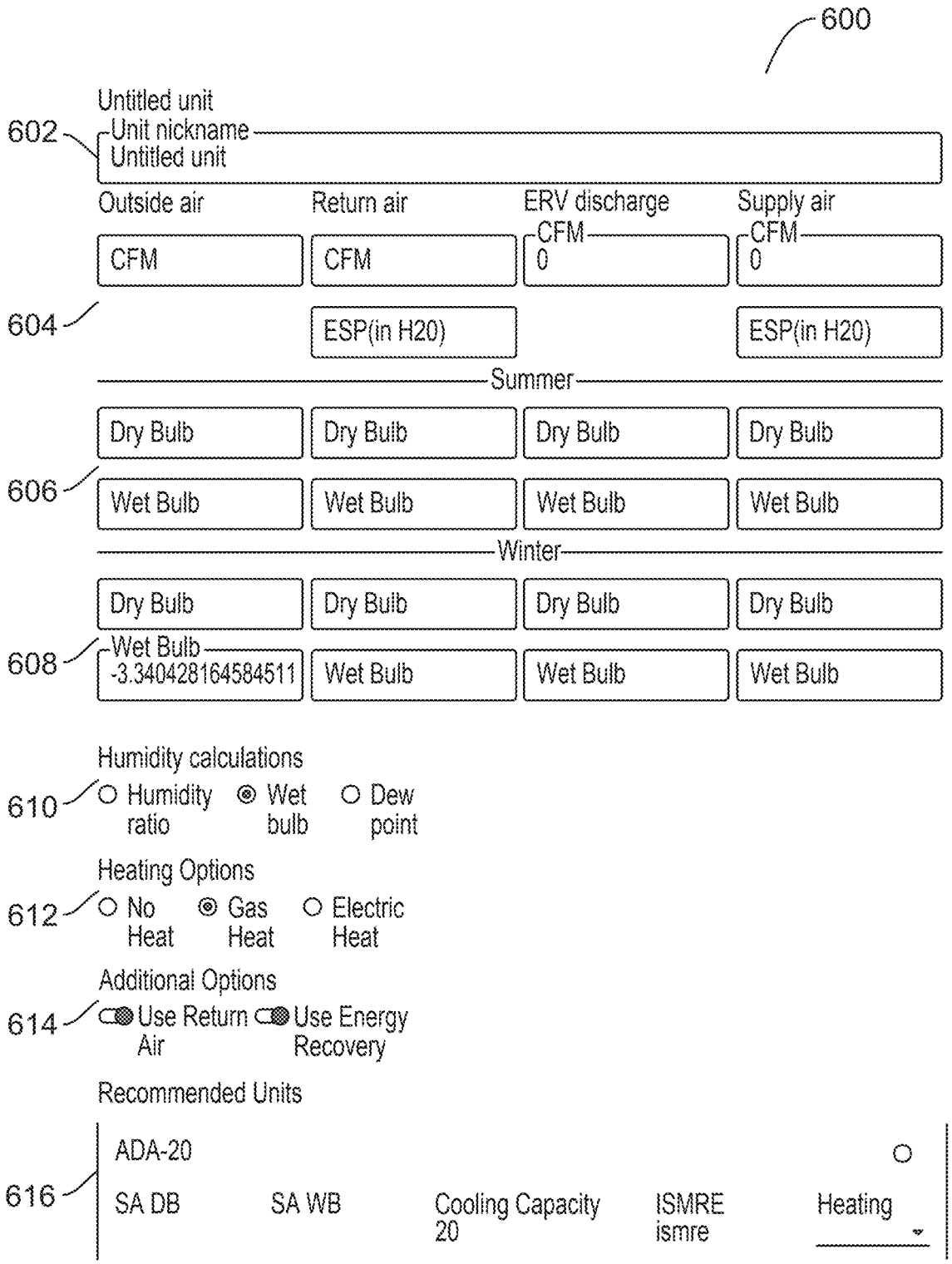
FIG. 6 shows an example of an air characteristic interface for a selection system, according to an embodiment.

FIG. 6 shows an example of an air characteristic interface 600 for a selection system, according to an embodiment. In some implementations, a user may continue to the air characteristic interface 600 after completing the setup interface 500. The air characteristic interface 600 can be shown on a user device, such as the user compute device 130 of FIG. 1 and/or the user device 230 of FIG. 2. In some implementations, the air characteristic interface 600 is shown on a display, such as the display 136 of FIG. 1 and can be interacted with by a user via peripheral(s) such as the peripheral(s) 138 of FIG. 1. The air characteristic interface 600 includes a unit name field 602, air characteristic fields 604, summer characteristic fields 606, winter characteristic fields 608, humidity calculation fields 610, heating options 612, additional options 614, and recommended units 616.

The unit name field 602 allows for a user to enter a nickname for a particular unit for a project. The air characteristic fields 604 allow for a user to enter air characteristics for the inlet characteristics (e.g., air flow rate, etc.), supply characteristics (e.g., flow rate, external static pressure, etc.), return characteristics (e.g., flow rate, external static pressure, etc.), and energy recovery characteristics (e.g., flow rate, etc.). The summer characteristic fields 606 allow for a user to enter air characteristics for summer conditions including wet bulb and dry bulb temperatures. The winter characteristic fields 608 allow for the user to enter air characteristics for winter conditions including wet bulb and dry bulb temperatures.

The humidity calculation fields 610 include an indication of user preference on humidity calculations. The choices of the user preference include using humidity ratio, wet bulb, dew point, and/or the like. The heating options 612 allow for the user to indicate a preference on whether heat is desired, or what type of heat is desired. For example, the user can choose between gas heat and electric heat. The additional options 614 include options for a user to indicate if using return air is desired or if using an energy recovery system is desired. In some implementations, certain data fields of the air characteristic interface 600 may be automatically populated based on a chosen recommended unit 616 or based on other entered data fields. Based on the user entered information, the air characteristic interface 600 includes recommended units 616, which are air processing units recommended for the user based on indicated parameters and desires. In some implementations, various data fields of the air characteristic interface 600 may be populated automatically based on signals from sensors, such as the sensors 150 of FIG. 1.

Referring generally to FIGS. 7-11, various psychrometric graphs are shown. The psychrometric graphs can be, in some implementations, generated by a system such as the system 10 of FIG. 1. In some implementations, the psychrometric graphs can be shown on a user device, such as the user compute device 130 of FIG. 1 and/or the user device 230 of FIG. 2. In some implementations, the psychrometric graphs are shown on a display, such as the display 136 of FIG. 1 and can be interacted with by a user via peripheral(s) such as the peripheral(s) 138 of FIG. 1. The psychrometric graphs include representations that are associated with values associated with air characteristics. The regions are representations of output areas of recommended air processing units. The psychrometric graphs include axes for dry bulb temperature, humidity ratio, and the associated relative humidity and specific volume at each point. In some implementations, the psychometric graphs can also display the dew point at each point. The psychrometric graphs can be used by a user to review different air characteristics and outputs in relation to each other. In some embodiments, the psychrometric graphs shown in FIGS. 7-11 can be generated, updated, or displayed in substantially real-time. For example, the psychrometric graphs can be updated as a user interacts with an interface such as the air characteristic interface 600 of FIG. 6. Updating the psychrometric graphs can allow for a user to see how changes to the air characteristics and other options affect the output on the psychrometric graphs in substantially real-time so that a user can make decisions on desired air characteristics and air processing units.

Figure 7:
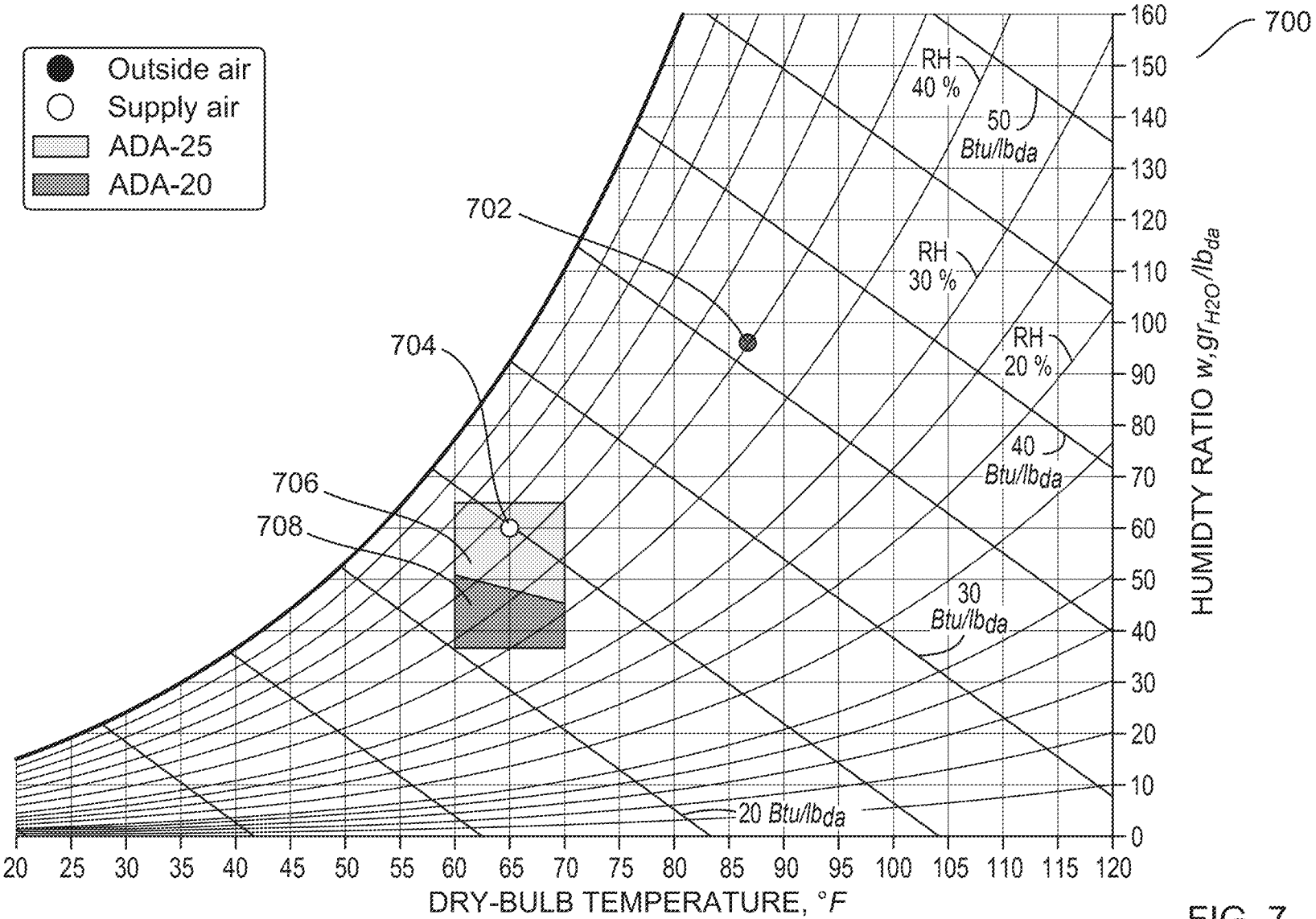
FIG. 7 shows a psychrometric diagram illustrating air processing unit capabilities and air characteristics, according to an embodiment.
Figure 8:
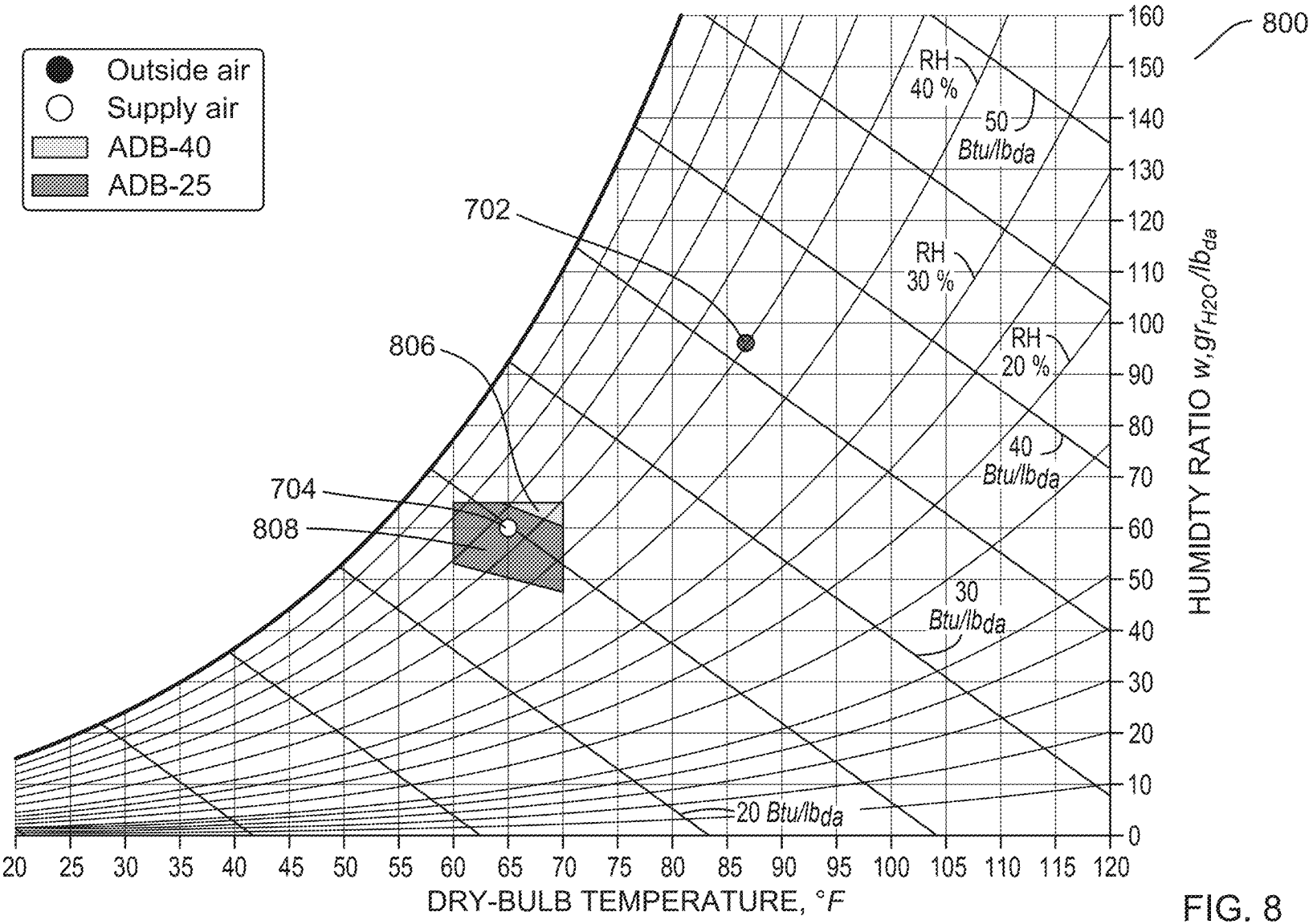
FIG. 8 shows another psychrometric diagram illustrating air processing unit capabilities and air characteristics, according to an embodiment.
Figure 9:
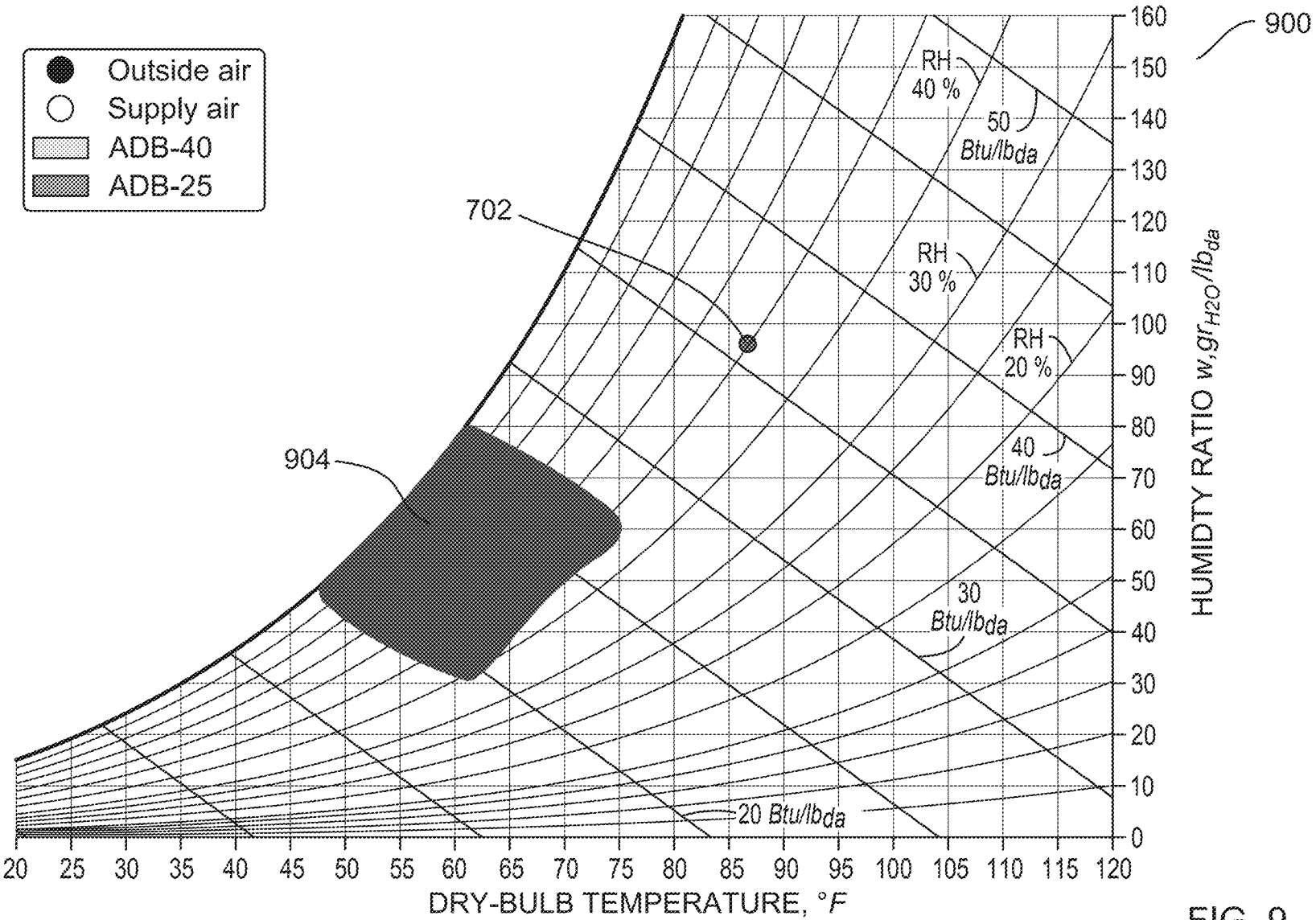
FIG. 9 shows another psychrometric diagram illustrating air processing unit capabilities and air characteristics, according to an embodiment.

FIG. 7 shows a psychrometric diagram 700 illustrating air processing unit capabilities and air characteristics, according to an embodiment. The psychrometric diagram 700 illustrates a representation 702 of an outside air characteristic, a representation 704 of a supply air characteristic, and a first region 706 associated with a first air processing unit and a second region 708 associated with a second air processing unit. As seen in FIG. 7, the representation 704 is within the first region 706, thus the first air processing unit may be desirable for the user. As seen in FIG. 8, a first region 806 associated with a third air processing unit and a second region 808 associated with a fourth air processing unit can overlap over the representation 704, thus indicating that the first air processing unit and the second air processing unit are recommended. FIG. 9 shows an alternative shape for a region 904. In some implementations, the shape of the region can be any shape that illustrates the possible outputs of an air processing unit.

Figure 10:
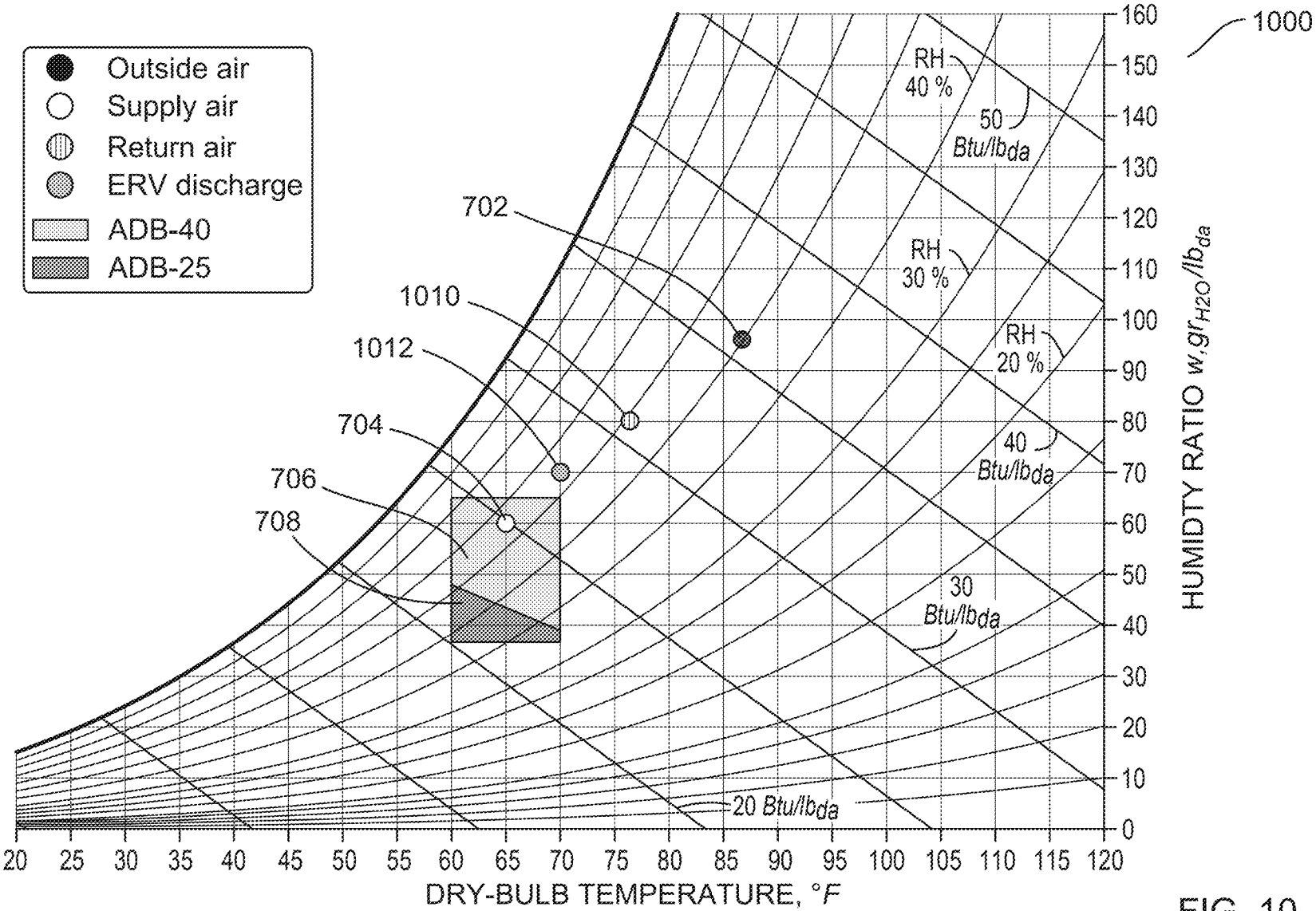
FIG. 10 shows another psychrometric diagram illustrating air processing unit capabilities and additional air characteristics, according to an embodiment.
Figure 11:
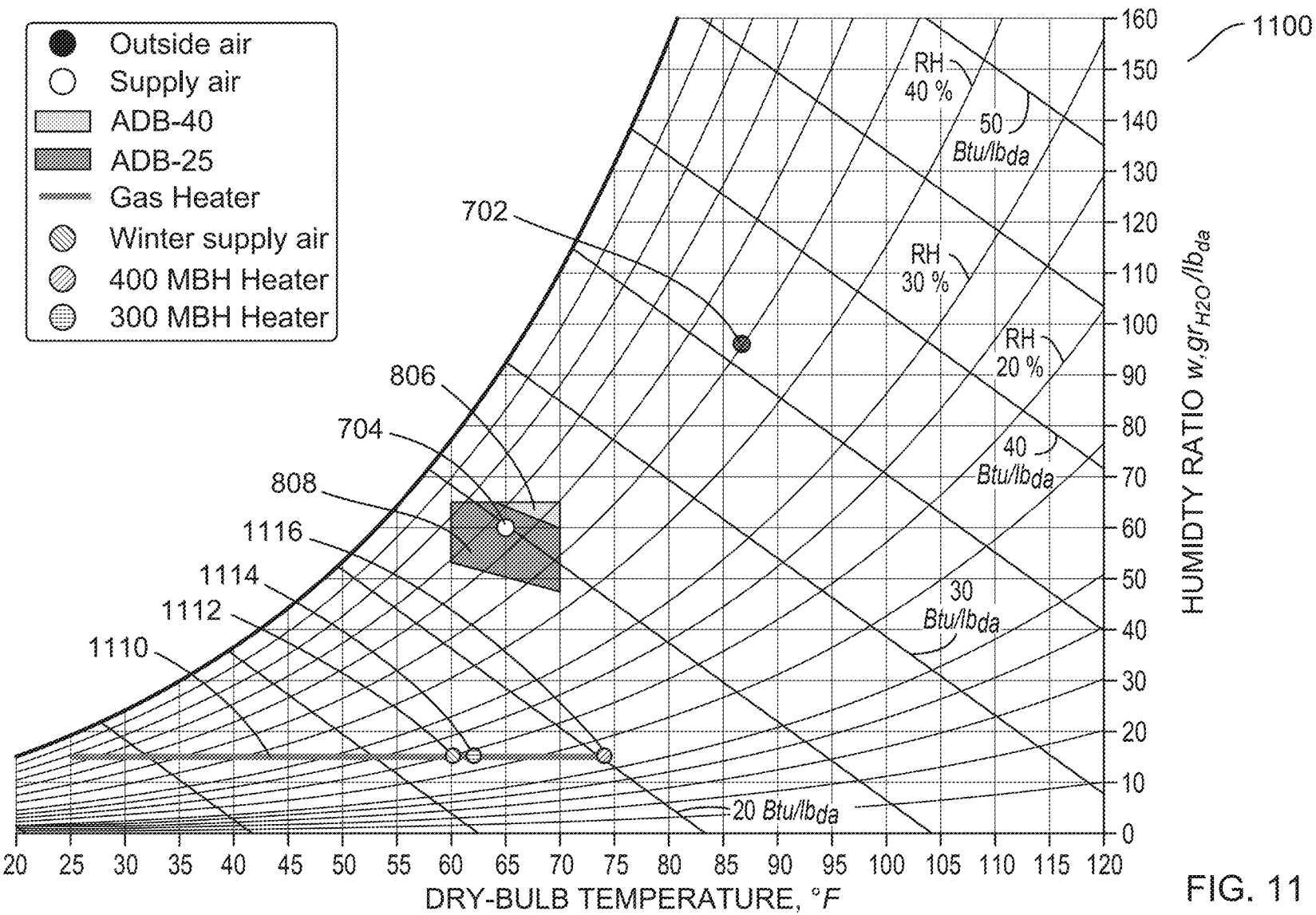
FIG. 11 shows a psychrometric diagram illustrating air processing unit capabilities, air characteristics, and heater performance, according to an embodiment.

Additional information (e.g., representations) can also be shown on psychrometric graphs. For example, the psychrometric graph 1000 of FIG. 10 is the same as the psychrometric graph 700 of FIG. 7 with the addition of a representation 1010 of an energy return system air characteristic and a representation 1012 of a return air characteristic. Similarly, FIG. 11 is the same as the psychrometric graph 800 of FIG. 8 with the addition of a representation 1110 of a gas heater operation in the winter in comparison with a representation 1112 of winter supply air characteristics, a representation of a first heater 1114, and a representation of a second heater 1116. The additional information can provide additional context to the user to aid in selection of the air processing unit and/or selection of a heater.

Figure 12:
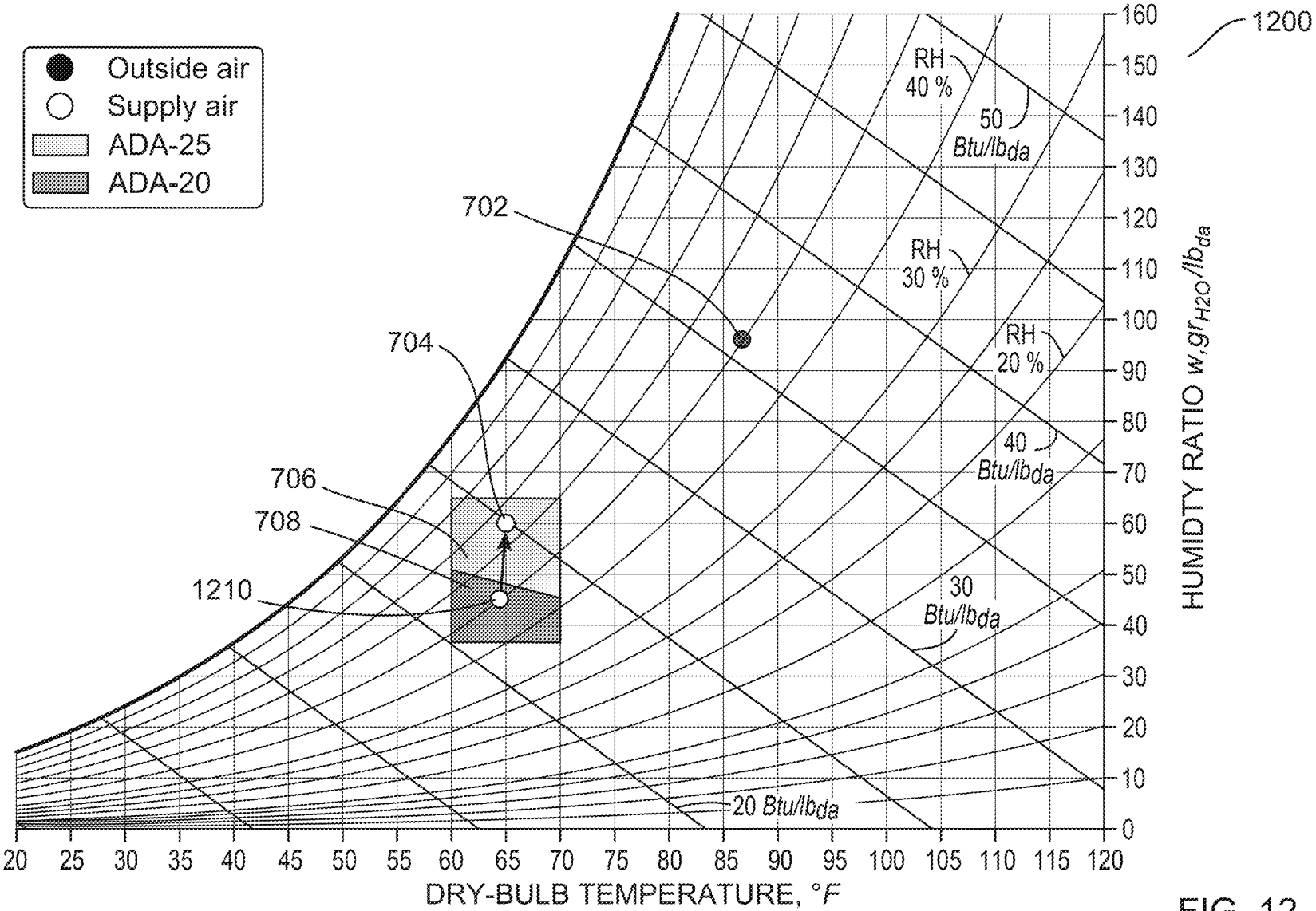
FIG. 12 shows a psychrometric diagram illustrating air processing unit capability and a change to desired air characteristics.

FIG. 12 shows a psychrometric graph 1200 which is the same as the psychometric graph 700 of FIG. 7 but with the representation 704 representing a second position that the user moved from a first position 1210. The user input may indicate a change in desired supply characteristics. As seen in FIG. 12, the first position 1210 is outside of the first region 706 and in the second region 708. Thus, based on the change, the first air processing unit may be recommended to the user instead of the second air processing unit as with the first position 1210. In some implementations, such as the one shown in FIG. 12, moving the representation may allow a user to alter the desired air characteristics to save money as one air processing unit may be less expensive than a second air processing unit. In some implementations, the user may move a representation from the first position 1210 to a second position anywhere on the psychrometric graph. In some implementations, additional regions can be generated that are associated with different air processing units that may include outputs that include the representation 704 (e.g., if the second representation 704 is outside of the first region 706 and the second region 708). In some implementations, the user can move the representation 704 by sending a command that includes the desired change to the representation 704. In some implementations, the user may move the representation 704 by dragging the representation 704 to the second position.

In some embodiments, a method for analysis of a desiccant air processing unit includes receiving, from a user device, an air characteristic. In some implementations, the air characteristic is generated based on a geographic location for the air processing unit. The method includes generating, based on the air characteristic, a psychrometric chart with a representation of the air characteristic. The method includes determining, based on the air characteristic and a plurality of air processing units, a subset of air processing units. The method includes generating, based on the subset of air processing units and the air characteristic, output data associated with possible outputs from air processing units from the subset of air processing units. The method includes defining a set of regions on the psychrometric chart based on the output data associated with each air processing unit from the subset of air processing units, each region from the set of regions being associated with a different air processing unit from the subset of air processing units. The method includes sending, to the user device, the psychrometric chart for output.

In some implementations, the air characteristic includes at least one of temperature, humidity, or flow rate.

In some implementations, the method further includes receiving, from the user device, a geographic location and the generating the output data is based on the geographic location.

In some implementations, the air characteristic is a first air characteristic, the subset of air processing units is a first subset of air processing units, the sending is at a first time, and the representation of the first air characteristic is in a first position on the psychrometric chart at the first time. The method further includes receiving, at a second time and from the user device, an indication that a user of the user device has moved the representation of the air characteristic to a second position on the psychrometric chart, calculating, based on the second position, a second air characteristic, determining, based on the second air characteristic and the plurality of air processing units, a second subset of air processing units, and defining a second set of regions on the psychrometric chart based on the output data associated with each air processing unit from the second subset of air processing units, each region from the second set of regions being associated with a different air processing unit from the second subset of air processing units.

In some implementations, the air characteristic is a first air characteristic. The method further includes receiving, from a user device, a second air characteristic and presenting, on the psychrometric chart, a representation of the second air characteristic.

In some implementations, the method further includes determining an energy usage for each air processing unit from the subset of air processing units.

In some implementations, the method further includes, based on the energy usage, determining a supply condition for each air processing unit from the subset of air processing units.

In some implementations, the supply condition is configured to minimize energy usage based on the air characteristic.

In some implementations, the method further includes receiving, from the user device, a supply dry bulb temperature and determining, based on the supply dry bulb temperature, a range of achievable humidity parameter for each air processing unit from the subset of air processing units.

In some implementations, the method further includes receiving, from the user device, a supply humidity parameter and determining, based on the supply humidity parameter, a range of achievable dry bulb temperature for each air processing unit from the subset of air processing units.

In some implementations, an apparatus includes one or more memories and one or more processors operatively coupled to the one or more memories. The one or more processors are configured to receive, from a user device, an air characteristic, determine, based on the air characteristic, a subset of air processing units, generate, based on the subset of air processing units and the air characteristic, output data associated with possible outputs from air processing units from the subset of air processing units and define a set of regions on a psychrometric chart based on the output data associated with each air processing unit from the subset of air processing units. Each region from the set of regions is associated with a different air processing unit from the subset of air processing units. The one or more processors are configured to send, to the user device, the psychrometric chart.

In some implementations, the air characteristic includes at least one of temperature, humidity, or flow rate. In some implementations, the one or more processors are further configured to determine, for each air processing unit from the subset of air processing units, an energy usage based on the air characteristic. In some implementations, the one or more processors are further configured to receive, from the user device, a geographic location and the generating the energy usage is based on the geographic location.

In some implementations, the one or more processors are further configured to select a candidate air processing unit based on the energy usage associated with each air processing unit from the subset of air processing units. In some implementations, the selecting can include selecting the air processing unit with a lowest energy usage of the subset of air processing units. In some implementations the selecting can include modifying the supply air conditions such that the required building loads are met with a lowest energy usage.

In some embodiments, an apparatus includes one or more memories and one or more processors operatively coupled to the one or more memories. The one or more processors are configured to receive, from a user device, an air characteristic (e.g., an inlet air characteristic, a target supply air characteristic, etc.). The one or more processors further configured to determine, based on the air characteristic, a subset of air processing units. The one or more processors further configured to determine, for each air processing unit from the subset of air processing units, an energy usage based on the target air characteristic. The one or more processors further configured to select a candidate air processing unit based on the energy usage associated with each air processing unit from the subset of air processing units. The one or more processors further configured to send, to the user device, the candidate air processing unit.

In some implementations, selecting the candidate air processing unit includes selecting the air processing unit with the lowest energy usage of the subset of air processing units.

In some implementations, the air characteristic includes at least one of temperature, humidity, or flow rate.

In some implementations, the one or more processors are further configured to receive, from the user device, a geographic location, wherein the generating the energy usage based on the geographic location.

In some embodiments, a method for analysis of a desiccant air processing unit includes generating, based on a predetermined air characteristic, a psychrometric chart with a representation of the predetermined air characteristic, the psychrometric chart including a representation of a supply characteristic. The method includes receiving, from a user device, an input associated with the representation of the supply characteristic. The method includes determining, based on the input and a plurality of air processing units, a subset of air processing units. The method includes generating, based on the subset of air processing units, output data associated with possible outputs from air processing units from the subset of air processing units. The method includes defining a set of regions on the psychrometric chart based on the output data associated with each air processing unit from the subset of air processing units, each region from the set of regions being associated with a different air processing unit from the subset of air processing units. The method includes sending, to the user device, the psychrometric chart for output.

In some implementations, the method further includes receiving, from the user device, load information associated with a space. The method further includes generating, based on the load information, the unit load of the air processing units from the subset of air processing units. The method further includes sending, to the user device, the unit load of the air processing units.

In some implementations, the load information including at least one of cooling information or humidity information.

In some implementations, the humidity information is dehumidification.

In some implementations, the load information can include changes to the load associated with the space.

In some implementations, the supply characteristic is changed to reduce energy use.

In some implementations, the supply characteristic is a target supply temperature.

In some implementations, the supply characteristic is a target supply humidity.

In some implementations, the supply characteristic is a target supply flow rate.

In some implementations, the predetermined air characteristic includes at least one of temperature, humidity, or flow rate.

In some implementations, the method includes receiving, from the user device, a geographic location and the generating the output data is based on the geographic location.

In some implementations, the method includes determining an energy usage (e.g., a typical annual energy usage) for each air processing unit of the subset of air processing units.

It should be understood that the disclosed embodiments are not intended to be exhaustive, and functional, logical, operational, organizational, structural and/or topological modifications may be made without departing from the scope of the disclosure. As such, all examples and/or embodiments are deemed to be non-limiting throughout this disclosure.

All definitions, as defined and used herein, should be understood to control over dictionary definitions, definitions in documents incorporated by reference, and/or ordinary meanings of the defined terms.

Examples of computer code include, but are not limited to, micro-code or micro-instructions, machine instructions, such as produced by a compiler, code used to produce a web service, and files containing higher-level instructions that are executed by a computer using an interpreter. For example, embodiments can be implemented using Python, Java, JavaScript, C++, and/or other programming languages and development tools. Additional examples of computer code include, but are not limited to, control signals, encrypted code, and compressed code.

The drawings primarily are for illustrative purposes and are not intended to limit the scope of the subject matter described herein. The drawings are not necessarily to scale; in some instances, various aspects of the subject matter disclosed herein can be shown exaggerated or enlarged in the drawings to facilitate an understanding of different features. In the drawings, like reference characters generally refer to like features (e.g., functionally similar and/or structurally similar elements).

The acts performed as part of a disclosed method(s) can be ordered in any suitable way. Accordingly, embodiments can be constructed in which processes or steps are executed in an order different than illustrated, which can include performing some steps or processes simultaneously, even though shown as sequential acts in illustrative embodiments. Put differently, it is to be understood that such features may not necessarily be limited to a particular order of execution, but rather, any number of threads, processes, services, servers, and/or the like that may execute serially, asynchronously, concurrently, in parallel, simultaneously, synchronously, and/or the like in a manner consistent with the disclosure. As such, some of these features may be mutually contradictory, in that they cannot be simultaneously present in a single embodiment. Similarly, some features are applicable to one aspect of the innovations, and inapplicable to others.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. That the upper and lower limits of these smaller ranges can independently be included in the smaller ranges is also encompassed within the disclosure, subject to any specifically excluded limit in the stated range. Where the stated range includes one or both of the limits, ranges excluding either or both of those included limits are also included in the disclosure.

The phrase "and/or," as used herein in the specification and in the embodiments, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements can optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the embodiments, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of" or "exactly one of," or, when used in the embodiments, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the embodiments, shall have its ordinary meaning as used in the field of patent law.

As used herein in the specification and in the embodiments, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements can optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the embodiments, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Some embodiments described herein relate to a computer storage product with a non-transitory computer-readable medium (also can be referred to as a non-transitory processor-readable medium) having instructions or computer code thereon for performing various computer-implemented operations. The computer-readable medium (or processor-readable medium) is non-transitory in the sense that it does not include transitory propagating signals per se (e.g., a propagating electromagnetic wave carrying information on a transmission medium such as space or a cable). The media and computer code (also can be referred to as code) can be those designed and constructed for the specific purpose or purposes. Examples of non-transitory computer-readable media include, but are not limited to, magnetic storage media such as hard disks, floppy disks, and magnetic tape; optical storage media such as Compact Disc/Digital Video Discs (CD/DVDs), Compact Disc-Read Only Memories (CD-ROMs), and holographic devices; magneto-optical storage media such as optical disks; carrier wave signal processing modules; and hardware devices that are specially configured to store and execute program code, such as Application-Specific Integrated Circuits (ASICs), Programmable Logic Devices (PLDs), Read-Only Memory (ROM) and Random-Access Memory (RAM) devices. Other embodiments described herein relate to a computer program product, which can include, for example, the instructions and/or computer code discussed herein.

Some embodiments and/or methods described herein can be performed by software (executed on hardware), hardware, or a combination thereof. Hardware modules may include, for example, a processor, a field programmable gate array (FPGA), and/or an application specific integrated circuit (ASIC). Software modules (executed on hardware) can include instructions stored in a memory that is operably coupled to a processor and can be expressed in a variety of software languages (e.g., computer code), including C, C++, Java™, Ruby, Visual Basic™, and/or other object-oriented, procedural, or other programming language and development tools. Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, Fortran, etc.), functional programming languages (Haskell, Erlang, etc.), logical programming languages (e.g., Prolog), object-oriented programming languages (e.g., Java, C++, etc.) or other suitable programming languages and/or development tools. Additional examples of computer code include, but are not limited to, control signals, encrypted code, and compressed code.

What is claimed is:

1. A method for analysis of a desiccant air processing unit, the method comprising:

receiving, via a graphical user interface (GUI) and from a user device, an air characteristic;

generating, based on the air characteristic, a psychrometric chart with a representation of the air characteristic;

determining, based on the air characteristic and a plurality of air processing units, a subset of air processing units;

generating, based on the subset of air processing units and the air characteristic, output data associated with outputs from air processing units from the subset of air processing units;

defining a set of regions on the psychrometric chart based on the output data associated with each air processing unit from the subset of air processing units, each region from the set of regions being associated with a different air processing unit from the subset of air processing units;

sending, to the user device, the psychrometric chart for output on the GUI;

receiving, from the user device and via the GUI, a user selection, the user selection associated with the representation being moved from a first position to a second position on the psychrometric chart;

determining, based on the second position, an updated air characteristic and an updated subset of air processing units;

automatically defining, based on the updated air characteristic and the updated subset of air processing units, an updated set of regions on the psychrometric chart to define an updated psychrometric chart for display on the GUI; and sending, to the user device and for display on the GUI, the updated psychrometric chart.

2. The method of claim 1, wherein the air characteristic includes at least one of temperature, humidity, or flow rate.

3. The method of claim 1, further comprising:

receiving, from the user device, a geographic location; and the generating the output data being based on the geographic location.

4. The method of claim 1, wherein the air characteristic is a first air characteristic, the method further comprising:

receiving, from a user device, a second air characteristic; and presenting, on the psychrometric chart, a representation of the second air characteristic.

5. The method of claim 1, further comprising:

determining an energy usage for each air processing unit from the subset of air processing units.

6. The method of claim 5, further comprising:

based on the energy usage, determining a supply condition for each air processing unit from the subset of air processing units.

7. The method of claim 6, wherein the supply condition is configured to minimize energy usage based on the air characteristic.

8. The method of claim 1, further comprising:

receiving, from the user device, a supply dry bulb temperature; and determining, based on the supply dry bulb temperature, a range of achievable humidity parameters for each air processing unit from the subset of air processing units.

9. The method of claim 1, further comprising:

receiving, from the user device, a supply humidity parameter; and determining, based on the supply humidity parameter, a range of achievable dry bulb temperatures for each air processing unit from the subset of air processing units.

10. An apparatus comprising:

one or more memories; and one or more processors operatively coupled to the one or more memories, the one or more processors configured to:

receive, via a graphical user interface (GUI) from a user device, an air characteristic;

determine, based on the air characteristic, a subset of air processing units;

generate, based on the subset of air processing units and the air characteristic, output data associated with outputs from air processing units from the subset of air processing units;

define a set of regions on a psychrometric chart based on the output data associated with each air processing unit from the subset of air processing units, each region from the set of regions being associated with a different air processing unit from the subset of air processing units;

send, to the user device, the psychrometric chart for output on the GUI;

receive, from the user device and via the GUI, a user selection, the user selection associated with a representation of the air characteristic on the psychrometric chart being moved from a first position to a second position;

determine, based on the second position, an updated air characteristic and an updated subset of air processing units;

automatically define, based on the updated air characteristic and the updated subset of air processing units, an updated set of regions on the psychrometric chart to define an updated psychrometric chart for display on the GUI; and send, to the user device and for display on the GUI, the updated psychrometric chart.

11. The apparatus of claim 10, wherein the air characteristic includes at least one of temperature, humidity, or flow rate.

12. The apparatus of claim 10, wherein the one or more processors are further configured to:

determine, for each air processing unit from the subset of air processing units, an energy usage based on the air characteristic.

13. The apparatus of claim 12, wherein the one or more processors are further configured to:

receive, from the user device, a geographic location, the energy usage is based on the geographic location.

14. The apparatus of claim 12, wherein the one or more processors are further configured to:

select a candidate air processing unit based on the energy usage associated with each air processing unit from the subset of air processing units, the selecting includes selecting the candidate air processing unit with a lowest energy usage from the subset of air processing units.

15. A method for analysis of a desiccant air processing unit, the method comprising:

generating, based on a predetermined air characteristic, a psychrometric chart with a representation of the predetermined air characteristic, the psychrometric chart including a representation of a supply characteristic;

receiving, via a graphical user interface (GUI) and from a user device, an input associated with the representation of the supply characteristic;

determining, based on the input and a plurality of air processing units, a subset of air processing units;

generating, based on the subset of air processing units, output data associated with outputs from air processing units from the subset of air processing units;

defining a set of regions on the psychrometric chart based on the output data associated with each air processing unit from the subset of air processing units, each region from the set of regions being associated with a different air processing unit from the subset of air processing units;

sending, to the user device, the psychrometric chart for output on the GUI;

receiving, from the user device and via the GUI, a user selection, the user selection associated with the representation being moved from a first position to a second position on the psychrometric chart;

determining, based on the second position, an updated air characteristic and an updated subset of air processing units;

automatically defining, based on the updated air characteristic and the updated subset of air processing units, an updated set of regions on the psychrometric chart to define an updated psychrometric chart for display on the GUI; and sending, to the user device and for display on the GUI, the updated psychrometric chart.

16. The method of claim 15, further comprising:

receiving, from the user device, load information associated with a space;

generating, based on the load information, a load for each air processing unit from the subset of air processing units; and sending, to the user device, the load for each air processing unit from the subset of air processing units.

17. The method of claim 16, wherein the load information includes at least one of cooling information or humidity information.

18. The method of claim 17, wherein the load information includes the humidity information, the humidity information is dehumidification.

19. The method of claim 16, wherein the load information can include changes to a load associated with the space.

20. The method of claim 16, wherein the supply characteristic is changed to reduce energy use.

21. The method of claim 20, wherein the supply characteristic is a target supply temperature.

22. The method of claim 20, wherein the supply characteristic is a target supply humidity.

23. The method of claim 20 wherein the supply characteristic is a target supply flow rate.

24. The method of claim 15, wherein the predetermined air characteristic includes at least one of temperature, humidity, or flow rate.

25. The method of claim 15, further comprising:

receiving, from the user device, a geographic location; and the generating the output data being based on the geographic location.

26. The method of claim 15, further comprising:

determining an energy usage for each air processing unit from the subset of air processing units.

* * * * *